US010962008B2

(12) United States Patent
Perevozchikov et al.

(10) Patent No.: US 10,962,008 B2
(45) Date of Patent: Mar. 30, 2021

(54) VARIABLE VOLUME RATIO COMPRESSOR

(71) Applicant: Emerson Climate Technologies, Inc., Sidney, OH (US)

(72) Inventors: Michael M. Perevozchikov, Tipp City, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 204 days.

(21) Appl. No.: 16/177,902

(22) Filed: Nov. 1, 2018

(65) Prior Publication Data

US 2019/0186491 A1 Jun. 20, 2019

Related U.S. Application Data

(60) Provisional application No. 62/599,182, filed on Dec. 15, 2017.

(51) Int. Cl.
*F04C 28/18* (2006.01)
*F04C 18/02* (2006.01)
(Continued)

(52) U.S. Cl.
CPC ..... *F04C 28/18* (2013.01); *F04C 18/0215* (2013.01); *F04C 18/0223* (2013.01);
(Continued)

(58) Field of Classification Search
CPC .. F04C 28/18; F04C 18/0215; F04C 18/0223; F04C 23/008; F04C 28/26; F04C 2240/603; F04C 2240/811
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1137614 A 12/1996
CN 1158944 A 9/1997
(Continued)

OTHER PUBLICATIONS

Notice of Allowance regarding U.S. Appl. No. 15/186,151, dated Jul. 25, 2019.
(Continued)

*Primary Examiner* — Connor J Tremarche
(74) *Attorney, Agent, or Firm* — Harness, Dickey & Pierce, P.L.C.

(57) ABSTRACT

A compressor may include a shell assembly, a non-orbiting scroll, and an orbiting scroll. The shell assembly may define a discharge chamber. The non-orbiting scroll includes a first end plate and a first spiral wrap extending from the first end plate. The first end plate may include a variable-volume-ratio port. The orbiting scroll may be disposed within the discharge chamber. The orbiting scroll includes a second end plate and a second spiral wrap extending from the second end plate and cooperating with the first spiral wrap to define a plurality of fluid pockets therebetween. The second end plate may include a discharge passage in communication with a radially innermost one of the fluid pockets and the discharge chamber. The variable-volume-ratio port may be disposed radially outward relative to the discharge passage and may be in selective communication with the radially innermost one of the fluid pockets.

24 Claims, 12 Drawing Sheets

(51) Int. Cl.
*F04C 28/26* (2006.01)
*F04C 23/00* (2006.01)

(52) U.S. Cl.
CPC ..... *F04C 23/008* (2013.01); *F04C 28/26* (2013.01); *F04C 2240/603* (2013.01); *F04C 2240/811* (2013.01)

(58) Field of Classification Search
USPC ..... 418/55.2
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,496,296 A 1/1985 Arai et al.
4,497,615 A * 2/1985 Griffith ..... F04C 28/16 417/310
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 MacHida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.

(56) References Cited

U.S. PATENT DOCUMENTS 6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 * 4/2005 Shibamoto ..... F01C 17/06 418/55.1
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
7,988,434 B2 8/2011 Stover et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,127,677 B2 9/2015 Doepker
9,145,891 B2 9/2015 Kim et al.
9,249,802 B2 2/2016 Doepker et al.
9,303,642 B2 4/2016 Akei et al.
9,435,340 B2 9/2016 Doepker et al.
9,494,157 B2 11/2016 Doepker
9,605,677 B2 3/2017 Heidecker et al.
9,624,928 B2 4/2017 Yamazaki et al.
9,651,043 B2 5/2017 Stover et al.
9,777,730 B2 10/2017 Doepker et al.
9,790,940 B2 10/2017 Doepker et al.
9,879,674 B2 1/2018 Akei et al.
9,989,057 B2 6/2018 Lochner et al.
10,066,622 B2 9/2018 Pax et al.
10,087,936 B2 10/2018 Pax et al.
10,094,380 B2 10/2018 Doepker et al.
2001/0010800 A1 8/2001 Kohsokabe et al.
2002/0039540 A1 * 4/2002 Kuroki ..... F04C 29/128 418/55.5
2002/0057975 A1 5/2002 Nakajima et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0305270 A1 12/2008 Uhlianuk et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 12/2010 Stover et al.
2011/0135509 A1 6/2011 Fields et al.
2011/0206548 A1 8/2011 Doepker
2011/0243777 A1 10/2011 Ito et al.

(56) References Cited

U.S. PATENT DOCUMENTS

| | | | | |
|---|---|---|---|---|
| 2011/0250085 | A1 | 10/2011 | Stover et al. | |
| 2011/0293456 | A1 | 12/2011 | Seibel et al. | |
| 2012/0009076 | A1 | 1/2012 | Kim et al. | |
| 2012/0107163 | A1 | 5/2012 | Monnier et al. | |
| 2012/0183422 | A1 | 7/2012 | Bahmata | |
| 2012/0195781 | A1 | 8/2012 | Stover et al. | |
| 2013/0078128 | A1 | 3/2013 | Akei | |
| 2013/0089448 | A1 | 4/2013 | Ginies et al. | |
| 2013/0094987 | A1 | 4/2013 | Yamashita et al. | |
| 2013/0121857 | A1 | 5/2013 | Liang et al. | |
| 2013/0302198 | A1 | 11/2013 | Ginies et al. | |
| 2013/0309118 | A1 | 11/2013 | Ginies et al. | |
| 2013/0315768 | A1 | 11/2013 | Le Coat et al. | |
| 2014/0023540 | A1 | 1/2014 | Heidecker et al. | |
| 2014/0024563 | A1 | 1/2014 | Heidecker et al. | |
| 2014/0037486 | A1 | 2/2014 | Stover et al. | |
| 2014/0134030 | A1 | 5/2014 | Stover et al. | |
| 2014/0134031 | A1 | 5/2014 | Doepker et al. | |
| 2014/0147294 | A1 | 5/2014 | Fargo et al. | |
| 2014/0154121 | A1 | 6/2014 | Doepker | |
| 2014/0154124 | A1* | 6/2014 | Doepker | F04C 29/005 418/55.5 |
| 2014/0219846 | A1* | 8/2014 | Ignatiev | F04C 28/18 418/16 |
| 2015/0037184 | A1 | 2/2015 | Rood et al. | |
| 2015/0086404 | A1 | 3/2015 | Kiem et al. | |
| 2015/0192121 | A1 | 7/2015 | Sung et al. | |
| 2015/0330386 | A1 | 11/2015 | Doepker | |
| 2015/0345493 | A1 | 12/2015 | Lochner et al. | |
| 2015/0354719 | A1 | 12/2015 | van Beek et al. | |
| 2016/0025093 | A1 | 1/2016 | Doepker | |
| 2016/0025094 | A1 | 1/2016 | Ignatiev et al. | |
| 2016/0032924 | A1 | 2/2016 | Stover | |
| 2016/0047380 | A1 | 2/2016 | Kim et al. | |
| 2016/0053759 | A1 | 2/2016 | Choi et al. | |
| 2016/0076543 | A1 | 3/2016 | Akei et al. | |
| 2016/0115954 | A1 | 4/2016 | Doepker et al. | |
| 2016/0138879 | A1 | 5/2016 | Matsukado et al. | |
| 2016/0201673 | A1 | 7/2016 | Perevozchikov et al. | |
| 2016/0208803 | A1 | 7/2016 | Uekawa et al. | |
| 2017/0002817 | A1 | 1/2017 | Stover | |
| 2017/0002818 | A1 | 1/2017 | Stover | |
| 2017/0030354 | A1 | 2/2017 | Stover | |
| 2017/0241417 | A1 | 8/2017 | Jin et al. | |
| 2017/0268510 | A1 | 9/2017 | Stover et al. | |
| 2017/0306960 | A1 | 10/2017 | Pax et al. | |
| 2017/0314558 | A1 | 11/2017 | Pax et al. | |
| 2017/0342978 | A1 | 11/2017 | Doepker | |
| 2017/0342983 | A1 | 11/2017 | Jin et al. | |
| 2017/0342984 | A1 | 11/2017 | Jin et al. | |
| 2018/0023570 | A1 | 1/2018 | Huang et al. | |
| 2018/0038369 | A1 | 2/2018 | Doepker et al. | |
| 2018/0038370 | A1 | 2/2018 | Doepker et al. | |
| 2018/0066656 | A1 | 3/2018 | Perevozchikov et al. | |
| 2018/0066657 | A1 | 3/2018 | Perevozchikov et al. | |
| 2018/0149155 | A1 | 5/2018 | Akei et al. | |
| 2018/0216618 | A1 | 8/2018 | Jeong | |
| 2018/0223823 | A1 | 8/2018 | Ignatiev et al. | |
| 2019/0040861 | A1 | 2/2019 | Doepker et al. | |
| 2019/0101120 | A1 | 4/2019 | Perevozchikov et al. | |
| 2019/0203709 | A1 | 7/2019 | Her et al. | |
| 2019/0353164 | A1 | 11/2019 | Berning et al. | |

FOREIGN PATENT DOCUMENTS

| | | | |
|---|---|---|---|
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 207513832 | U | 6/2018 |
| CN | 209621603 | U | 11/2019 |
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H8320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |

(56) References Cited

FOREIGN PATENT DOCUMENTS

| | | | |
|---|---|---|---|
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2013104305 | A | 5/2013 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.
Office Action regarding Chinese Patent Application No. 201180010366.1, dated Jun. 4, 2014. Translation provided by Unitalen Attorneys at Law.
Office Action regarding Chinese Patent Application No. 201610516097.0, dated Jun. 27, 2017. Translation provided by Unitalen Attorneys at Law.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.
Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.
Office Action regarding European Patent Application No. 11747996.4, dated Jun. 26, 2019.
Office Action regarding Chinese Patent Application No. 201710795228.8, dated Oct. 28, 2019. Translation provided by Unitalen Attorneys at Law.
Office Action regarding European Patent Application No. 11747996.4, dated Nov. 5, 2019.
Notice of Allowance regarding U.S. Appl. No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Office Action regarding U.S. Appl. No. 15/831,423, dated Jan. 31, 2020.
U.S. Appl. No. 16/147,920, filed Oct. 1, 2018, Michael M. Perevozchikov et al.
U.S. Appl. No. 16/154,406, filed Oct. 8, 2018, Roy J. Doepker et al.
U.S. Appl. No. 16/154,844, filed Oct. 9, 2018, Jeffrey Lee Berning et al.
Luckevich, Mark, "MEMS microvalves: the new valve world." Valve World, May 2007, pp. 79-83.
Non-Final Office Action for U.S. Appl. No. 11/522,250, dated Aug. 1, 2007.
Extended European Search Report regarding Application No. EP07254962, dated Mar. 12, 2008.
Notification of the First Office Action received from the Chinese Patent Office, dated Mar. 6, 2009 regarding Application No. 200710153687.2, translated by CCPIT Patent and Trademark Law Office.
Non-Final Office Action for U.S. Appl. No. 12/103,265, dated May 27, 2009.
U.S. Office Action regarding U.S. Appl. No. 11/645,288, dated Nov. 30, 2009.
Non-Final Office Action for U.S. Appl. No. 12/103,265, dated Dec. 17, 2009.

(56) References Cited

OTHER PUBLICATIONS

Notice of Grounds for Rejection regarding Korean Patent Application No. 10-2007-0093478, dated Feb. 25, 2010. Translation provided by Y.S. Chang & Associates.
Final Office Action for U.S. Appl. No. 12/103,265, dated Jun. 15, 2010.
First China Office Action regarding Application No. 200710160038.5, dated Jul. 8, 2010. Translation provided by Unitalen Attorneys At Law.
Final Preliminary Notice of Grounds for Rejection regarding Korean Patent Application No. 10-2007-0093478, dated Aug. 31, 2010. Translation provided by Y.S. Chang & Associates.
Advisory Action for U.S. Appl. No. 12/103,265, dated Sep. 17, 2010.
International Search Report regarding Application No. PCT/US2010/030248, dated Nov. 26, 2010.
Written Opinion of the International Searching Authority regarding Application No. PCT/US2010/030248, dated Nov. 26, 2010.
International Search Report regarding Application No. PCT/US2011/025921, dated Oct. 7, 2011.
Written Opinion of the International Search Authority regarding Application No. PCT/US2011/025921, dated Oct. 7, 2011.
China Office Action regarding Application No. 200710160038.5, dated Jan. 31, 2012. Translation provided by Unitalen Attorneys at Law.
First Office Action regarding Chinese Patent Application No. 201010224582.3, dated Apr. 17, 2012. English translation provided by Unitalen Attorneys at Law.
First Examination Report regarding Indian Patent Application No. 1071/KOL/2007, dated Apr. 27, 2012.
Non-Final Office Action for U.S. Appl. No. 13/0365,529, dated Aug. 22, 2012.
U.S. Office Action regarding U.S. Appl. No. 13/181,065, dated Nov. 9, 2012.
International Search Report regarding Application No. PCT/US2013/051678, dated Oct. 21, 2013.
Written Opinion of the International Searching Authority regarding Application No. PCT/US2013/051678, dated Oct. 21, 2013.
China Office Action regarding Application No. 201080020243.1, dated Nov. 5, 2013. Translation provided by Unitalen Attorneys at Law.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
Second Office Action regarding China Application No. 201180010366.1, dated Dec. 31, 2014. Translation provided by Unitalen Attorneys at Law.
Office Action regarding U.S. Appl. No. 14/081,390, dated Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
International Search Report regarding International Application No. PCT/US2015/042479, dated Oct. 23, 2015.
Written Opinion of the International Searching Authority regarding International Application No. PCT/US2015/042479, dated Oct. 23, 2015.
Office Action regarding Chinese Patent Application No. 201410461048.2, dated Nov. 30, 2015. Translation provided by Unitalen Attorneys at Law.
Interview Summary regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.
First Office Action regarding Chinese Application No. 201380059666.8, dated Apr. 5, 2016. Translation provided by Unitalen Attorneys at Law.
First Office Action regarding Chinese Application No. 201380062614.6, dated Apr. 5, 2016. Translation provided by Unitalen Attorneys at Law.
Advisory Action regarding U.S. Appl. No. 14/073,293, dated Apr. 18, 2016.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys at Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.

(56) References Cited

OTHER PUBLICATIONS

Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Patent Application No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Restriction Requirement regarding U.S. Appl. No. 14/809,786, dated Aug. 16, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys at Law.
Office Action regarding Chinese Patent Application No. 201610512702.7, dated Dec. 20, 2017. Partial translation provided by Unitalen Attorneys at Law.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding Chinese Patent Application No. 201610499158.7, dated Jan. 9, 2018. Translation provided by Unitalen Attorneys at Law.
Non-Final Office Action for U.S. Appl. No. 14/809,786, dated Jan. 11, 2018.
Office Action regarding Chinese Patent Application No. 201580029636.1, dated Jan. 17, 2018. Translation provided by Unitalen Attorneys at Law.
Office Action regarding Chinese Patent Application No. 201580041209.5, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
Election Requirement regarding U.S. Appl. No. 15/186,092, dated Apr. 3, 2018.
Election Requirement regarding U.S. Appl. No. 15/784,458, dated Apr. 5, 2018.
Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Election/Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Election/Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Applicant-Initiated Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.
Office Action regarding Korean Patent Application No. 10-2017-7033995, dated Nov. 29, 2018. Translation provided by KS Koryo International IP Law Firm.
Notice of Allowance regarding U.S. Appl. No. 15/692,844, dated Feb. 20, 2020.
Office Action regarding European Patent Application No. 13859308.2, dated Mar. 4, 2020.
Office Action regarding Chinese Patent Application No. 201811168307.7, dated Mar. 27, 2020. Translation provided by Unitalen Attorneys at Law.
Office Action regarding Korean Patent Application No. 10-2018-0159231, dated Apr. 7, 2020. Translation provided by KS Koryo International IP Law Firm.
Office Action regarding Chinese Patent Application No. 201780055443.2, dated Apr. 14, 2020. Translation provided by Unitalen Attorneys at Law.
Notice of Allowance regarding U.S. Appl. No. 15/682,599, dated Apr. 22, 2020.
Notice of Allowance regarding U.S. Appl. No. 15/831,423, dated May 20, 2020.
Notice of Allowance regarding U.S. Appl. No. 15/692,844, dated Jun. 4, 2020.
Restriction Requirement regarding U.S. Appl. No. 16/147,920, dated Jun. 25, 2020.
Office Action regarding U.S. Appl. No. 16/154,406, dated Jun. 29, 2020.
U.S. Appl. No. 15/186,092, filed Jun. 17, 2016, Robert C. Stover.
U.S. Appl. No. 15/186,151, filed Jun. 17, 2016, Robert C. Stover.
U.S. Appl. No. 15/187,225, filed Jun. 20, 2016, Robert C. Stover.
U.S. Appl. No. 15/587,735, filed May 5, 2017, Robert C. Stover et al.
U.S. Appl. No. 15/682,599, filed Aug. 22, 2017, Michael M. Perevozchikov et al.

(56) References Cited

OTHER PUBLICATIONS

U.S. Appl. No. 15/692,844, filed Aug. 31, 2017, Michael M. Perevozchikov et al.
U.S. Appl. No. 15/784,458, filed Oct. 16, 2017, Roy J. Doepker et al.
U.S. Appl. No. 15/784,540, filed Oct. 16, 2017, Roy J. Doepker et al.
U.S. Appl. No. 15/831,423, filed Dec. 5, 2017, Kirill M. Ignatiev et al.
U.S. Appl. No. 15/881,016, filed Jan. 26, 2018, Masao Akei et al.
Restriction Requirement regarding U.S. Appl. No. 16/154,844, dated Jul. 2, 2020.
Office Action regarding Chinese Patent Application No. 201811480347.5, dated Jul. 21, 2020. Translation provided by Unitalen Attorneys at Law.
Office Action regarding U.S. Appl. No. 15/881,016, dated Jul. 21, 2020.
Office Action regarding U.S. Appl. No. 16/147,920, dated Sep. 25, 2020.
Notice of Allowance regarding U.S. Appl. No. 16/154,406, dated Oct. 2, 2020.
Office Action regarding U.S. Appl. No. 16/154,844, dated Oct. 5, 2020.

* cited by examiner

VARIABLE VOLUME RATIO COMPRESSOR

CROSS-REFERENCE TO RELATED APPLICATIONS

This application claims the benefit of U.S. Provisional Application No. 62/599,182, filed on Dec. 15, 2017. The entire disclosure of the above application is incorporated herein by reference.

FIELD

The present disclosure relates to a variable volume ratio compressor.

BACKGROUND

This section provides background information related to the present disclosure and is not necessarily prior art.

Compressors are used in a variety of industrial, commercial and residential applications to circulate a working fluid within a climate-control system (e.g., a refrigeration system, an air conditioning system, a heat-pump system, a chiller system, etc.) to provide a desired cooling and/or heating effect. A typical climate-control system may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor may include a shell assembly, a non-orbiting scroll, and an orbiting scroll. The shell assembly may define a discharge chamber. The non-orbiting scroll includes a first end plate and a first spiral wrap extending from the first end plate. The first end plate may include a variable-volume-ratio port. The orbiting scroll may be disposed within the discharge chamber. The orbiting scroll includes a second end plate and a second spiral wrap extending from the second end plate and cooperating with the first spiral wrap to define a plurality of fluid pockets therebetween. The second end plate may include a discharge passage in communication with a radially innermost one of the fluid pockets and the discharge chamber. The variable-volume-ratio port may be disposed radially outward relative to the discharge passage and may be in selective communication with the radially innermost one of the fluid pockets.

In some configurations of the compressor of the above paragraph, the radially innermost one of the fluid pockets is in communication with the discharge chamber only through the discharge passage.

In some configurations of the compressor of either of the above paragraphs, the orbiting scroll includes an annular hub extending from the second end plate in a direction opposite the second spiral wrap. The annular hub may define a cavity that receives a driveshaft. The discharge passage may be open to and directly adjacent to the cavity.

In some configurations of the compressor of any of the above paragraphs, the non-orbiting scroll is enclosed within the shell assembly and is disposed within the discharge chamber.

In some configurations of the compressor of any of the above paragraphs, the non-orbiting scroll sealingly engages the shell assembly to seal the discharge chamber.

In some configurations of the compressor of any of the above paragraphs, the non-orbiting scroll is exposed to an ambient environment outside of the compressor. That is, the non-orbiting scroll may function as an end cap of the shell assembly.

In some configurations of the compressor of any of the above paragraphs, the compressor includes a discharge fitting extending through the shell assembly and in communication with the discharge chamber. The discharge fitting may be spaced apart from the non-orbiting scroll.

In some configurations of the compressor of any of the above paragraphs, the compressor includes a variable-volume-ratio valve member movable relative to the non-orbiting scroll between an open position in which the variable-volume-ratio valve member allows fluid flow between the variable-volume-ratio port and the discharge chamber and a closed position in which the variable-volume-ratio valve member restricts fluid flow between the variable-volume-ratio port and the discharge chamber.

In some configurations of the compressor of any of the above paragraphs, the first end plate of the non-orbiting scroll includes a valve recess in which the variable-volume-ratio valve member is movable between the open and closed positions. The valve recess may be in communication with the discharge chamber and the variable-volume-ratio port when the variable-volume-ratio valve member is in the open position.

In some configurations of the compressor of any of the above paragraphs, the compressor includes a valve backer and a spring. The valve backer may close an end of the valve recess. The spring may be disposed between the valve backer and the variable-volume-ratio valve member and may bias the variable-volume-ratio valve member toward the closed position.

In some configurations of the compressor of any of the above paragraphs, the valve backer is received within the valve recess.

In some configurations of the compressor of any of the above paragraphs, the first end plate includes another variable-volume-ratio port disposed radially outward relative to the discharge passage.

In some configurations of the compressor of any of the above paragraphs, the compressor includes another variable-volume-ratio valve member movable relative to the non-orbiting scroll between an open position allowing fluid flow between the another variable-volume-ratio port and the discharge chamber and a closed position restricting fluid flow between the another variable-volume-ratio port and the discharge chamber.

In some configurations of the compressor of any of the above paragraphs, the valve recess is an annular recess. The variable-volume-ratio valve member may be an annular member that closes both of the variable-volume-ratio ports in the closed position and opens both of the variable-volume-ratio ports in the open position.

In some configurations of the compressor of any of the above paragraphs, the first end plate includes a capacity-modulation port in communication with a radially intermediate one of the fluid pockets.

In some configurations of the compressor of any of the above paragraphs, the compressor includes a capacity-modulation valve assembly movable between a first position restricting communication between the capacity-modulation port and a suction-pressure region and a second position allowing communication between the capacity-modulation port and the suction-pressure region.

In some configurations of the compressor of any of the above paragraphs, the capacity-modulation valve assembly is movable to a third position restricting communication between the capacity-modulation port and the suction-pressure region and allowing communication between fluid-injection passage and the capacity-modulation port.

The present disclosure also provides a compressor that may include a shell assembly, a non-orbiting scroll, and an orbiting scroll. The shell assembly may define a discharge chamber. The non-orbiting scroll includes a first end plate and a first spiral wrap extending from the first end plate. The first end plate may include a variable-volume-ratio port and a first discharge passage. The variable-volume-ratio port may be disposed radially outward relative to the first discharge passage and may be in selective communication with the discharge chamber. The first discharge passage may be in communication with the discharge chamber. The orbiting scroll may be disposed within the discharge chamber and includes a second end plate and a second spiral wrap extending from the second end plate and cooperating with the first spiral wrap to define a plurality of fluid pockets therebetween. The second end plate may include a second discharge passage in communication with the discharge chamber. The first discharge passage and the second discharge passage may be in communication with an innermost one of the fluid pockets and the discharge chamber.

In some configurations of the compressor of the above paragraph, the second discharge passage is in selective fluid communication with the variable-volume-ratio port.

In some configurations of the compressor of either of the above paragraphs, the first discharge passage extends entirely through the first end plate.

In some configurations of the compressor of any of the above paragraphs, the second discharge passage extends entirely through the second end plate.

In some configurations of the compressor of any of the above paragraphs, the orbiting scroll includes an annular hub extending from the second end plate in a direction opposite the second spiral wrap. The annular hub may define a cavity that receives a driveshaft. The second discharge passage may be open to and directly adjacent to the cavity.

In some configurations of the compressor of any of the above paragraphs, the non-orbiting scroll is enclosed within the shell assembly and is disposed within the discharge chamber.

In some configurations of the compressor of any of the above paragraphs, the compressor includes a variable-volume-ratio valve member movable relative to the non-orbiting scroll between an open position in which the variable-volume-ratio valve member allows fluid flow between the variable-volume-ratio port and the discharge chamber and a closed position in which the variable-volume-ratio valve member restricts fluid flow between the variable-volume-ratio port and the discharge chamber.

In some configurations of the compressor of any of the above paragraphs, the variable-volume-ratio port communicates with the discharge chamber via one or both of the first and second discharge passages when the variable-volume-ratio valve member is in the open position.

In some configurations of the compressor of any of the above paragraphs, the first end plate of the non-orbiting scroll includes a valve recess in which the variable-volume-ratio valve member is movable between the open and closed positions. The valve recess may be in communication with the first and second discharge passages and the variable-volume-ratio port when the variable-volume-ratio valve member is in the open position.

In some configurations of the compressor of any of the above paragraphs, the compressor includes a valve backer and a spring. The valve backer may close an end of the valve recess. The spring may be disposed between the valve backer and the variable-volume-ratio valve member and may bias the variable-volume-ratio valve member toward the closed position.

In some configurations of the compressor of any of the above paragraphs, the valve backer is received within the valve recess.

In some configurations of the compressor of any of the above paragraphs, the first end plate includes another variable-volume-ratio port disposed radially outward relative to the first discharge passage.

In some configurations of the compressor of any of the above paragraphs, the compressor includes another variable-volume-ratio valve member movable relative to the non-orbiting scroll between an open position allowing fluid flow between the another variable-volume-ratio port and the discharge chamber via one or both of the first and second discharge passages and a closed position restricting fluid flow between the another variable-volume-ratio port and the discharge chamber.

In some configurations of the compressor of any of the above paragraphs, the first end plate includes a capacity-modulation port in communication with a radially intermediate one of the fluid pockets.

In some configurations of the compressor of any of the above paragraphs, the compressor includes a capacity-modulation valve assembly movable between a first position restricting communication between the capacity-modulation port and a suction-pressure region and a second position allowing communication between the capacity-modulation port and the suction-pressure region.

In some configurations of the compressor of any of the above paragraphs, the capacity-modulation valve assembly is movable to a third position restricting communication between the capacity-modulation port and the suction-pressure region and allowing communication between fluid-injection passage and the capacity-modulation port.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 7A:
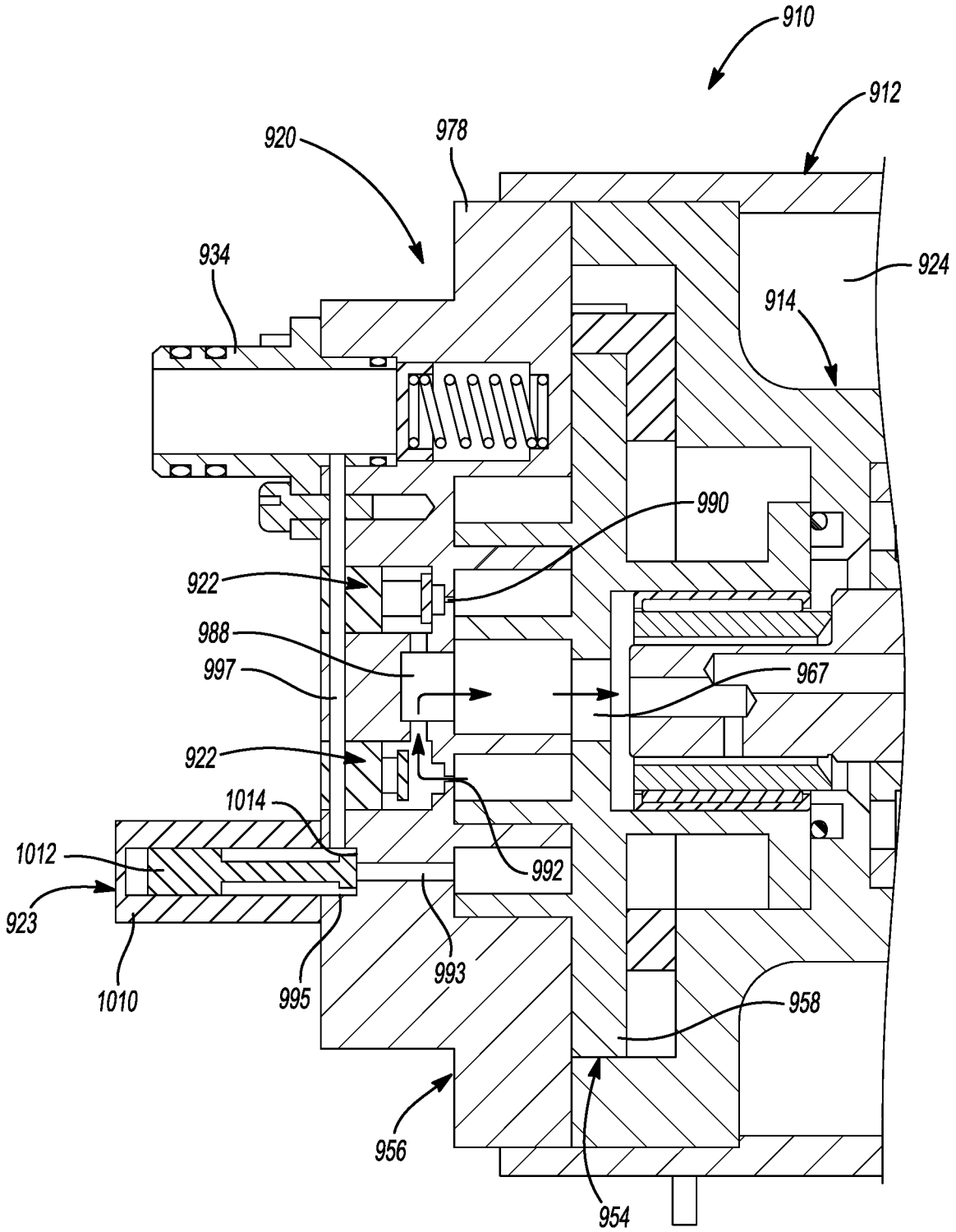
Figure 7B:
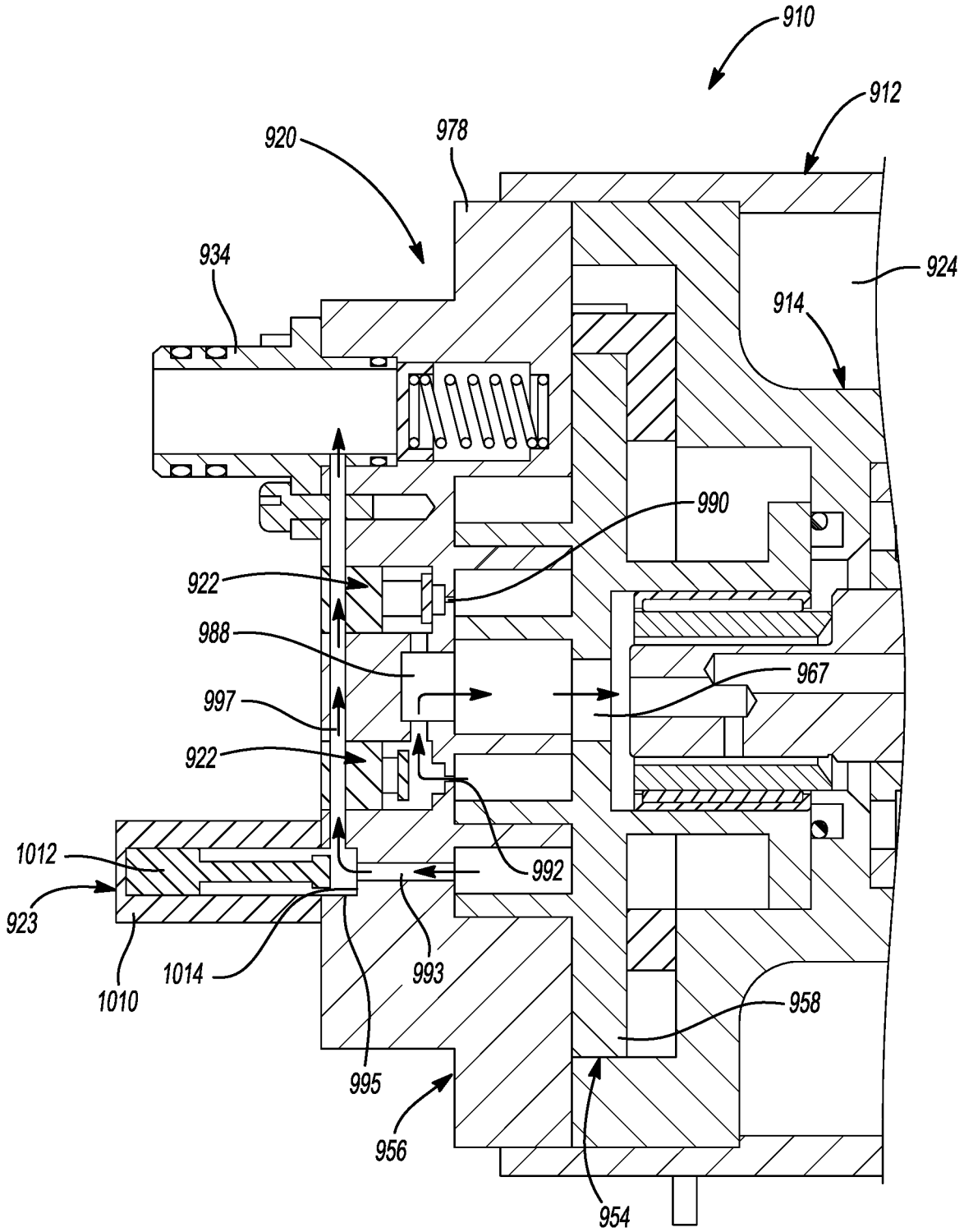
Figure 8A:
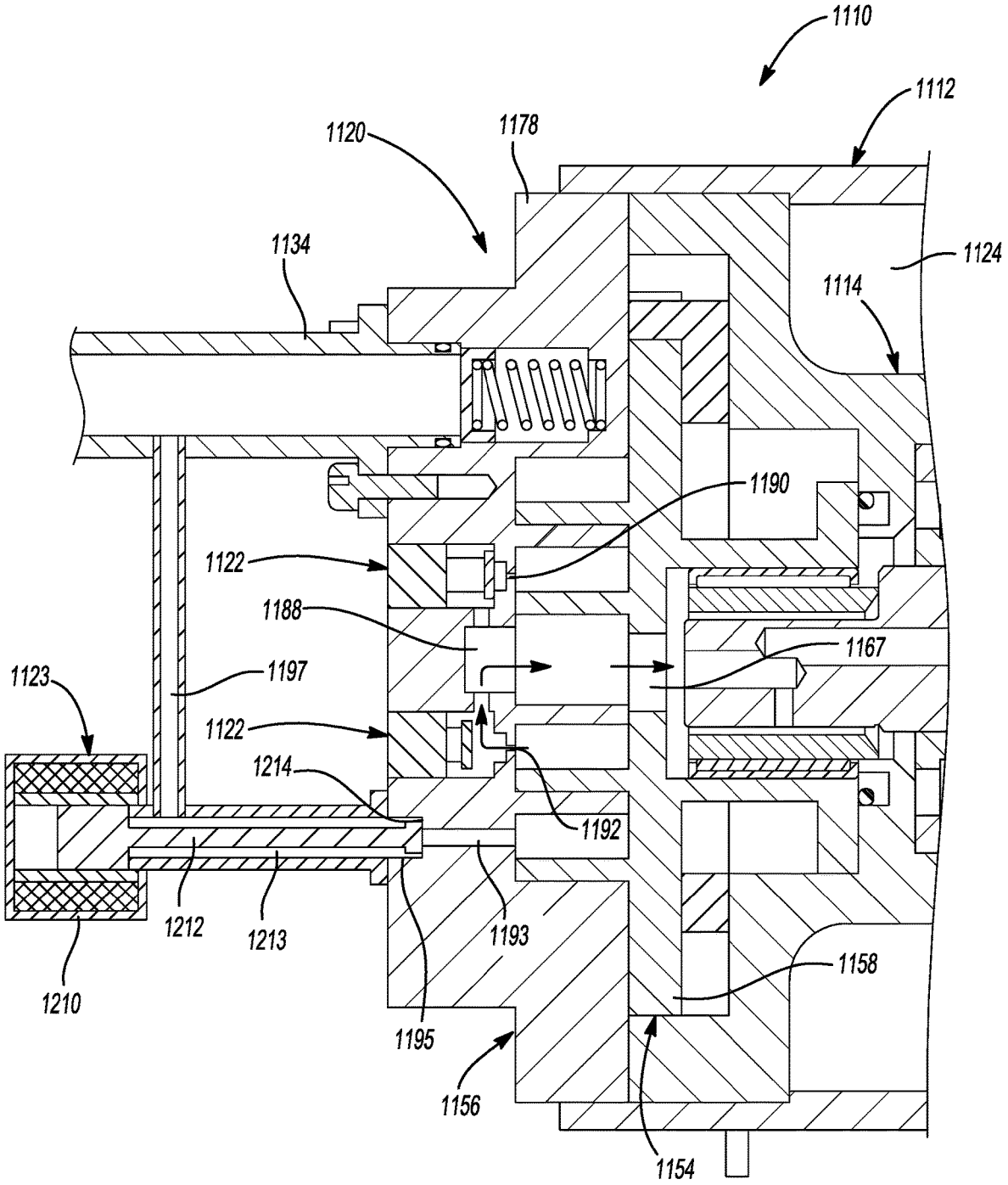
Figure 8B:
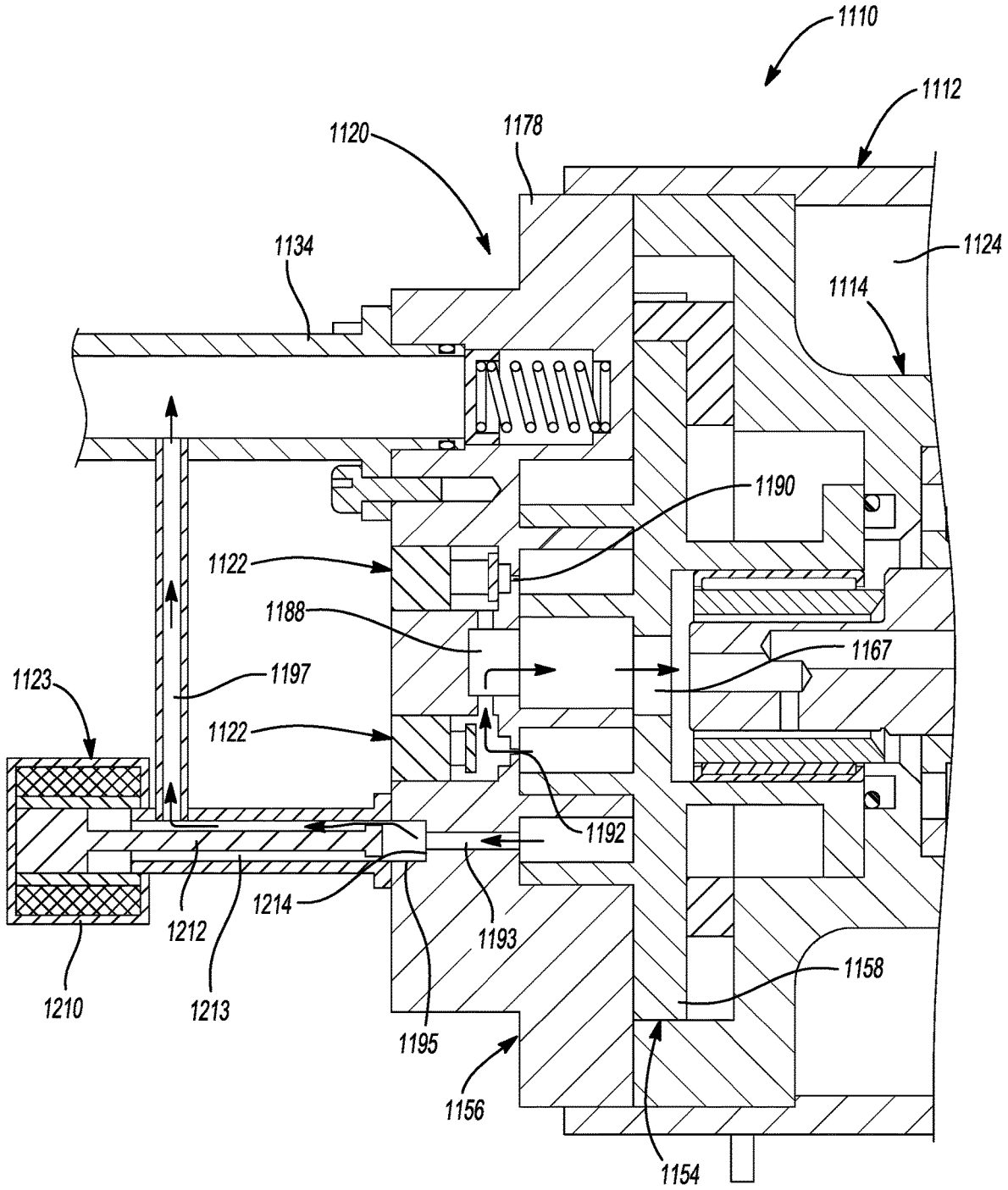
Figure 9A:
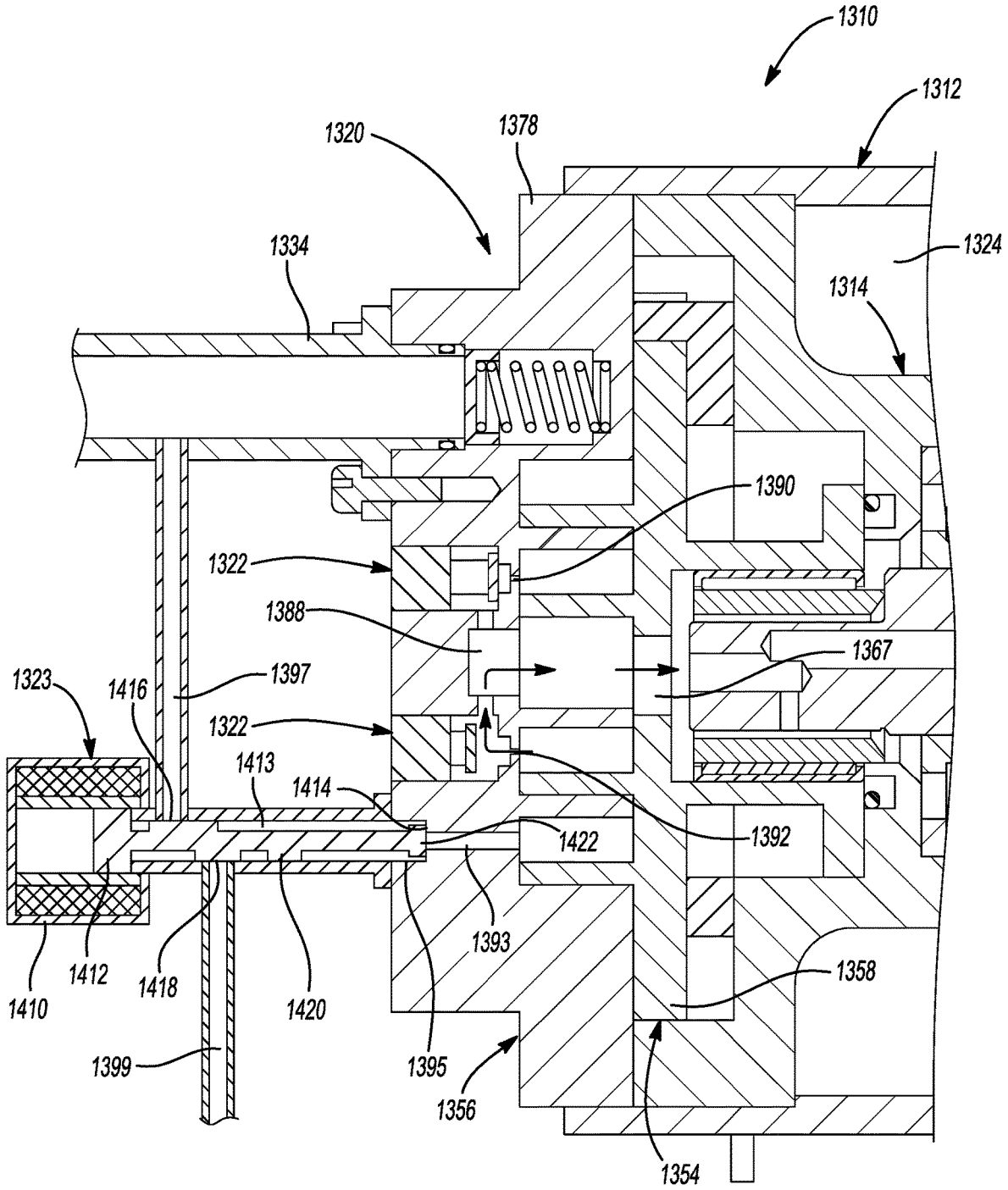
Figure 9B:
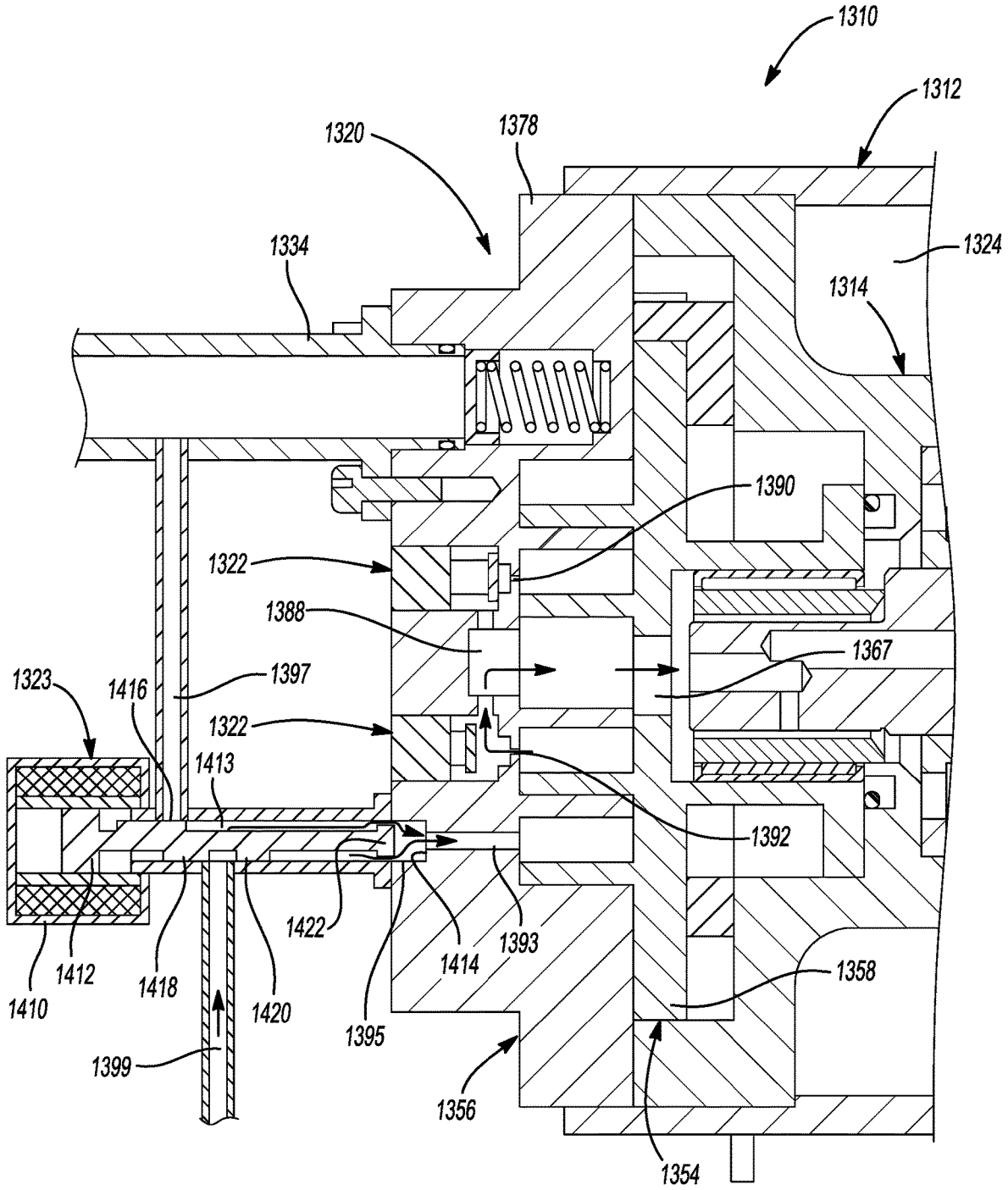
Figure 9C:
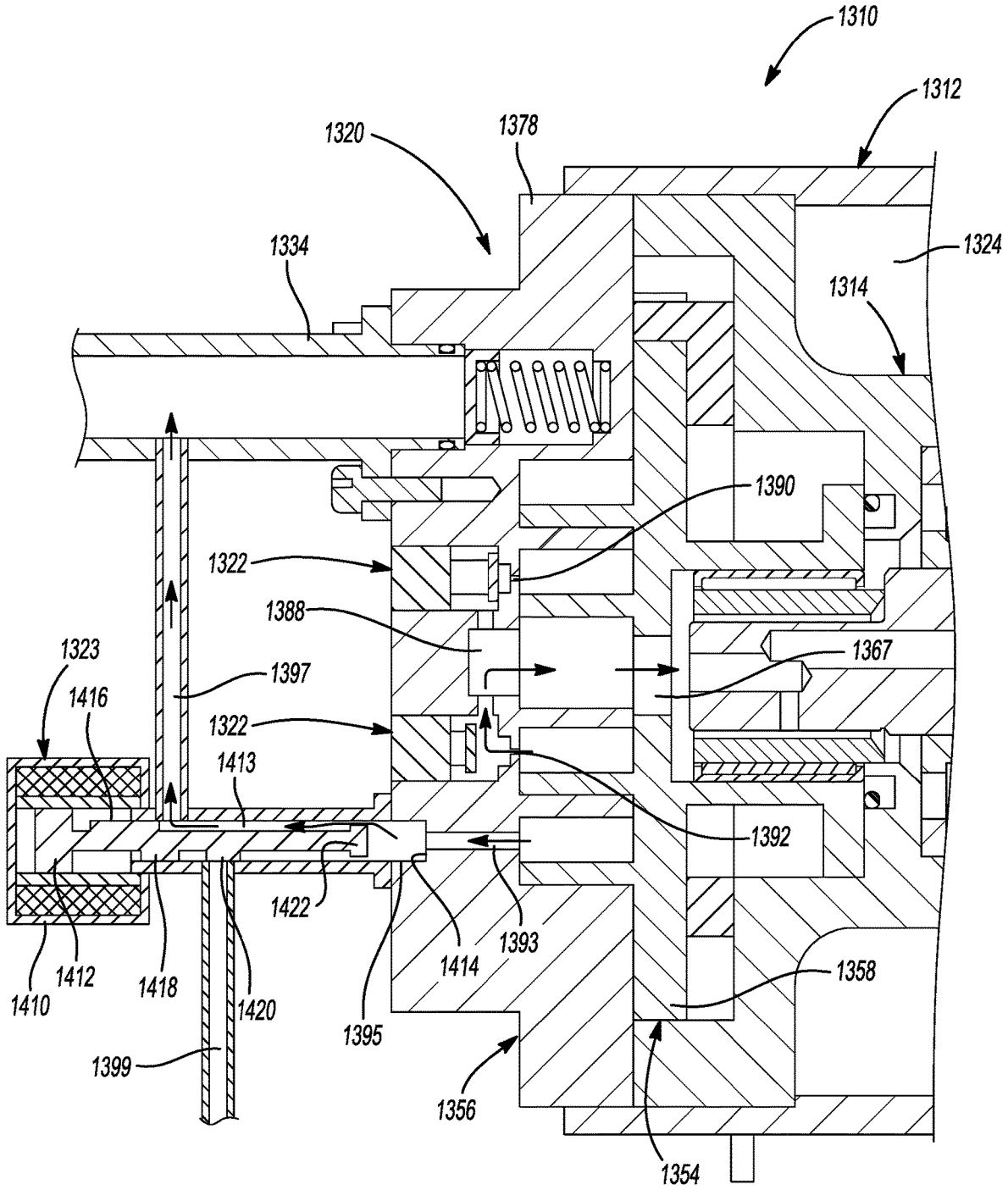

FIG. 7*a* is a partial cross-sectional view of yet another compressor with a capacity-modulation valve member in a closed position according to the principles of the present disclosure;

FIG. 7*b* is a partial cross-sectional view of the compressor of FIG. 7*a* with the capacity-modulation valve member in an open position according to the principles of the present disclosure;

FIG. 8*a* is a partial cross-sectional view of yet another compressor with a capacity-modulation valve member in a closed position according to the principles of the present disclosure;

FIG. 8*b* is a partial cross-sectional view of the compressor of FIG. 8*a* with the capacity-modulation valve member in an open position according to the principles of the present disclosure;

FIG. 9*a* is a partial cross-sectional view of yet another compressor with a capacity-modulation valve member in a first position according to the principles of the present disclosure;

FIG. 9*b* is a partial cross-sectional view of the compressor of FIG. 9*a* with the capacity-modulation valve member in a second position according to the principles of the present disclosure; and FIG. 9*c* is a partial cross-sectional view of the compressor of FIG. 9*a* with the capacity-modulation valve member in a third position according to the principles of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
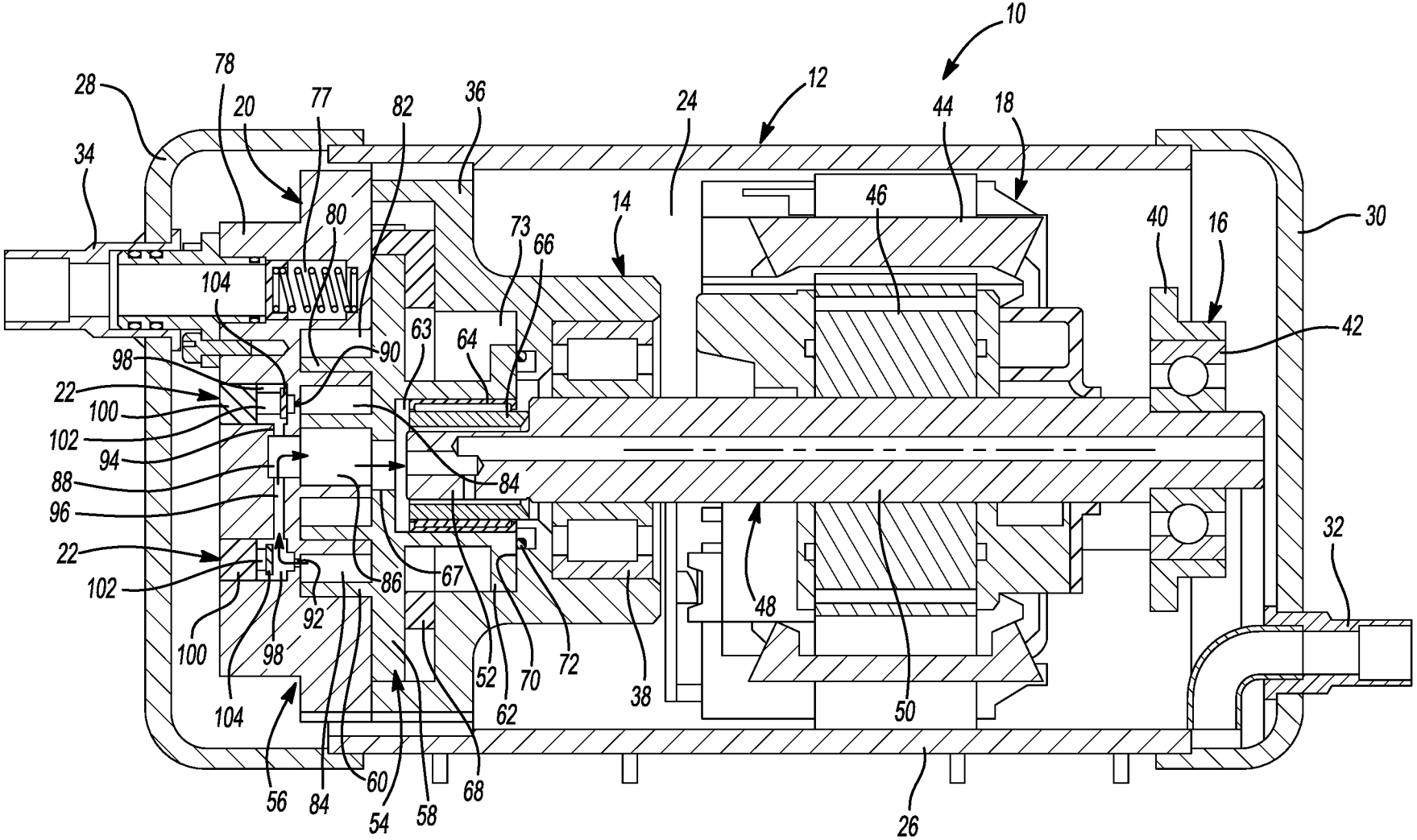
FIG. 1 is a cross-sectional view of a compressor having variable-volume-ratio valve assembly according to the principles of the present disclosure.
Figure 2:
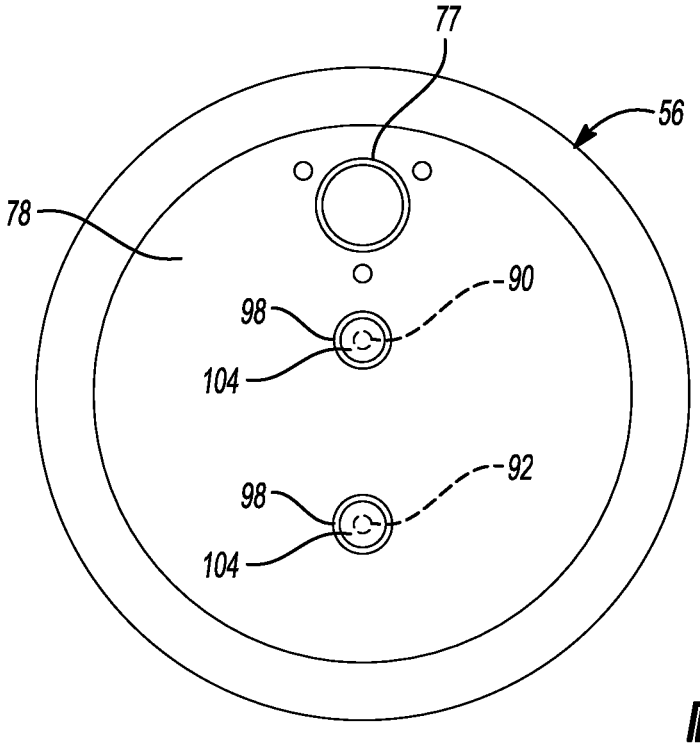
FIG. 2 is a plan view of a scroll of the compressor of FIG. 1.

With reference to FIGS. 1 and 2, a compressor 10 is provided. As shown in FIG. 1, the compressor 10 may be a high-side scroll compressor including a hermetic shell assembly 12, a first and second bearing assemblies 14, 16, a motor assembly 18, a compression mechanism 20, and one or more variable-volume-ratio (VVR) valve assemblies 22. As described in more detail below, the VVR valve assemblies 22 are operable to prevent the compression mechanism 20 from over-compressing working fluid.

The shell assembly 12 may define a high-pressure discharge chamber 24 (containing compressed working fluid) and may include a cylindrical shell 26, a first end cap 28 at one end thereof, and a base or second end cap 30 at another end thereof. A discharge fitting 32 may be attached to the shell assembly 12 and extend through a first opening in the shell assembly 12 to allow working fluid in the discharge chamber 24 to exit the compressor 10. For example, the discharge fitting 32 may extend through the second end cap 30, as shown in FIG. 1. An inlet fitting 34 may be attached to the shell assembly 12 (e.g., at the first end cap 28) and extend through a second opening in the shell assembly 12. The inlet fitting 34 may extend through a portion of the discharge chamber 24 and is fluidly coupled to a suction inlet of the compression mechanism 20. In this manner, the inlet fitting 34 provides low-pressure (suction-pressure) working fluid to the compression mechanism 20 while fluidly isolating the suction-pressure working fluid within the inlet fitting 34 from the high-pressure (e.g., discharge-pressure) working fluid in the discharge chamber 24.

The first and second bearing assemblies 14, 16 may be disposed entirely within the discharge chamber 24. The first bearing assembly 14 may include a first bearing housing 36 and a first bearing 38. The first bearing housing 36 may be fixed to the shell assembly 12. The first bearing housing 36 houses the first bearing 38 and axially supports the compression mechanism 20. The second bearing assembly 16 may include a second bearing housing 40 and a second bearing 42. The second bearing housing 40 is fixed to the shell assembly 12 and supports the second bearing 42.

The motor assembly 18 may be disposed entirely within the discharge chamber 24 and may include a motor stator 44, a rotor 46, and a driveshaft 48. The stator 44 may be fixedly attached (e.g., by press fit) to the shell 26. The rotor 46 may be press fit on the driveshaft 48 and may transmit rotational power to the driveshaft 48. The driveshaft 48 may include a main body 50 and an eccentric crank pin 52 extending from an end of the main body 50. The main body 50 is received in the first and second bearings 38, 42 and is rotatably supported by the first and second bearing assemblies 14, 16. Therefore, the first and second bearings 38, 42 define a rotational axis of the driveshaft 48. The crank pin 52 may engage the compression mechanism 20.

The compression mechanism 20 may be disposed entirely within the discharge chamber 24 and may include an orbiting scroll 54 and a non-orbiting scroll 56. The orbiting scroll 54 may include an end plate 58 having a spiral wrap 60 extending from a first side of the end plate 58. An annular hub 62 may extend from a second side of the end plate 58 and may include a cavity 63 in which a drive bearing 64, a drive bushing 66 and the crank pin 52 may be disposed. The drive bushing 66 may be received within the drive bearing 64. The crank pin 52 may be received within the drive bushing 66.

The end plate 58 of the orbiting scroll 54 may also include a discharge passage 67 that may be open to and disposed directly adjacent to the cavity 63. The discharge passage 67 is in communication with the discharge chamber 24 via the cavity 63. The cavity 63 is in communication with the discharge chamber 24 via gaps between the hub 62 and the drive bearing 64, between the drive bearing 64 and drive bushing 66, and/or between the drive bushing 66 and the crank pin 52. In some configurations, cavity 63 is in communication with the discharge chamber 24 via flow passages formed in any one or more of the hub 62, drive bearing 64, or drive bushing 66, for example.

An Oldham coupling 68 may be engaged with the end plate 58 and either the non-orbiting scroll 56 or the first bearing housing 36 to prevent relative rotation between the orbiting and non-orbiting scrolls 54, 56. The annular hub 62 may be axially supported by a thrust surface 70 of the first bearing housing 36. The annular hub 62 may movably engage a seal 72 attached to the first bearing housing 36 to define an intermediate-pressure cavity 73 between the first bearing housing 36 and the orbiting scroll 54.

The non-orbiting scroll 56 may include an end plate 78 and a spiral wrap 80 projecting from the end plate 78. The spiral wrap 80 may meshingly engage the spiral wrap 60 of the orbiting scroll 54, thereby creating a series of moving fluid pockets therebetween. The fluid pockets defined by the spiral wraps 60, 80 may decrease in volume as they move from a radially outer position 82 to a radially intermediate position 84 to a radially innermost position 86 throughout a compression cycle of the compression mechanism 20. The inlet fitting 34 is fluidly coupled with a suction inlet 77 in the end plate 78 and provides suction-pressure working fluid to the fluid pockets at the radially outer positions 82.

The end plate 78 of the non-orbiting scroll 56 may include a discharge recess 88, one or more first VVR ports 90, and one or more second VVR ports 92. The discharge recess 88 may be in communication with the fluid pocket at the radially innermost position 86 and is in communication with the discharge passage 67 in the orbiting scroll 54. The first and second VVR ports 90, 92 are disposed radially outward relative to the discharge passage 67 and the discharge recess 88 and communicate with respective fluid pockets at the radially intermediate positions 84. The first and second VVR ports 90, 92 may be in selective communication with the discharge recess 88 via first and second radial passages 94, 96, respectively. In the configuration shown in FIG. 1, the discharge recess 88 extends only partially through the end plate 78 (i.e., the discharge recess 88 does not directly communicate with the discharge chamber 24).

Each of the VVR valve assemblies 22 may be disposed in a respective valve recess 98 formed in the end plate 78 of the non-orbiting scroll 56. As will be described in more detail below, the VVR valve assemblies 22 are operable to selectively allow and restrict communication between the first and second VVR ports 90, 92 and the discharge recess 88. Therefore, the VVR valve assemblies 22 are operable to selectively allow and restrict communication between the first and second VVR ports 90, 92 and the discharge chamber 24 (i.e., since the discharge recess 88 is in communication with the discharge chamber via the discharge passage 67).

Each of the VVR valve assemblies 22 may include a valve backer 100, a spring 102, and a VVR valve member 104. The valve backers 100 may be a cylindrical block fixed to the end plate 78 and may close off or plug an end of the valve recesses 98. In some configurations, one or both valve backers 100 may be fixedly received (e.g., via threaded engagement, press fit, etc.) within the respective valve recesses 98, as shown in FIG. 1. In other configurations, one or both valve backers 100 may be attached (e.g., via fasteners, welding, etc.) to an end of the end plate 78 and may cover the respective valve recesses 98.

In the configuration shown in FIGS. 1 and 2, the valve members 104 are generally disk-shaped bodies (e.g., with flat or curved end faces). In other configurations, the valve members 104 could have or include other shapes, such as spherical, conical, frusto-conical, cylindrical, and/or annular for example. The valve members 104 may be received within the respective valve recesses 98 and are independently movable therein between a closed position and an open position. In the closed positions, the valve members 104 are in contact with valve seats defined by ends of the valve recesses 98, thereby restricting fluid flow between the VVR ports 90, 92 and the radial passages 94, 96. In the open positions, the valve members 104 are spaced apart from the valve seats, thereby allowing fluid to flow from the VVR ports 90, 92 to the radial passages 94, 96 and into the discharge recess 88 and subsequently through the discharge passage 67 to the discharge chamber 24. FIG. 1 depicts the valve member 104 corresponding to the first VVR port 90 in the closed position and the valve member 104 corresponding to the second VVR port 92 in the open position. The springs 102 may be disposed between the respective valve backers 100 and valve members 104 and may bias the valve members 104 toward the closed positions. The springs 102 may be coil springs, for example, or any other resiliently compressible bodies.

The VVR ports 90, 92 and the VVR valve assemblies 22 are operable to prevent the compression mechanism 20 from over-compressing working fluid. Over-compression is a compressor operating condition where the internal compressor-pressure ratio of the compressor (i.e., a ratio of a pressure of a fluid pocket in the compression mechanism at a radially innermost position to a pressure of a fluid pocket in the compression mechanism at a radially outermost position) is higher than a pressure ratio of a climate-control system in which the compressor is installed (i.e., a ratio of a pressure at a high side of the climate-control system to a pressure of a low side of the climate-control system). In an over-compression condition, the compression mechanism is compressing fluid to a pressure higher than the pressure of fluid downstream of a discharge fitting of the compressor. Accordingly, in an over-compression condition, the compressor is performing unnecessary work, which reduces the efficiency of the compressor. The VVR valve assemblies 22 of the present disclosure may reduce or prevent over-compression by selectively venting the fluid pockets at the radially intermediate positions 84 to the discharge chamber 24 (via the VVR ports 90, 92, the radial passages 94, 96, the discharge recess 88, the discharge passage 67, and the cavity 63) when the pressure within such fluid pockets has exceeded (or sufficiently exceeded) the pressure in the discharge chamber 24.

When fluid pressure within fluid pockets at the radially intermediate positions 84 are sufficiently higher (i.e., higher by a predetermined value determined based on the spring rate of the springs 102) than the fluid pressure within the discharge chamber 24, the fluid pressure within the fluid pockets at the radially intermediate positions 84 can move the valve members 104 toward the valve backers 100 (compressing the springs 102) to the open position to open the VVR ports 90, 92 and allow communication between the VVR ports 90, 92 and the discharge chamber 24. That is, while the VVR ports 90, 92 are open (i.e., while the valve members 104 are in the open positions), working fluid in the fluid pockets at the radially intermediate positions 84 can flow into the discharge chamber 24 (via the VVR ports 90, 92, the radial passages 94, 96, the discharge recess 88, the discharge passage 67, and the cavity 63). When the fluid pressures within fluid pockets at the radially intermediate positions 84 are less than, equal to, or not sufficiently higher than the fluid pressure within the discharge chamber 24, the springs 102 will force the valve members 104 back to the closed positions to seal against the valve seats defined by the end plate 78 to restrict or prevent communication between the discharge chamber 24 and the VVR ports 90, 92.

It will be appreciated that the valve members 104 can move between the open and closed positions together or independently of each other based on the fluid pressures within the respective fluid pockets to which the respective VVR ports 90, 92 are exposed. In other words, one of the valve members 104 could be in the open position while the other of the valve members 104 could be in the closed position, as shown in FIG. 1.

While the valve members 104 shown in FIG. 1 translates between open and closed positions and is biased toward the closed position by the spring 102, in some configurations, the valve members 104 could be configured such that the valve members 104 resiliently deflect or bend between open and closed positions. For example, the valve members 104 could be reed valves.

Figure 3:
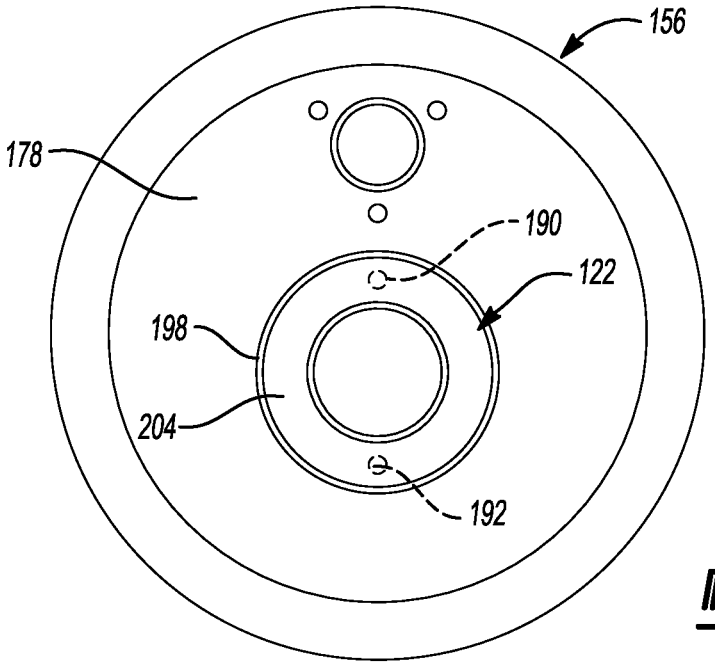
FIG. 3 is a plan view of alternative scroll that could be incorporated into the compressor of FIG. 1.

With reference to FIG. 3, another non-orbiting scroll 156 and VVR valve assembly 122 are provided that may be incorporated into the compressor 10 instead of the non-orbiting scroll 56 and the VVR valve assemblies 22. The structure and function of the non-orbiting scroll 156 may be similar or identical to that of the non-orbiting scroll 56 described above, apart from differences described below. Therefore, similar features will not be described again in detail.

Like the non-orbiting scroll 56, the non-orbiting scroll 156 includes an end plate 178 and a spiral wrap (not shown) extending therefrom. The end plate 178 may include an annular valve recess 198 that selectively communicates with first and second VVR ports 190, 192 (similar or identical to VVR ports 90, 92) formed in the end plate 178.

The VVR valve assembly 122 may include an annular VVR valve member 204. The annular valve member 204 may be received within the annular valve recess 198 and can move between open and closed positions to allow and restrict communication between the VVR ports 190, 192 and the discharge chamber 24. In some configurations, an annular valve backer (not shown) may be fixedly disposed within or cover the annular valve recess 198 to retain the valve member 204 within the annular valve recess 198. One or more springs (not shown) may be disposed between the valve backer and the valve member 204 and bias the valve member 204 toward the closed position.

Figure 4:
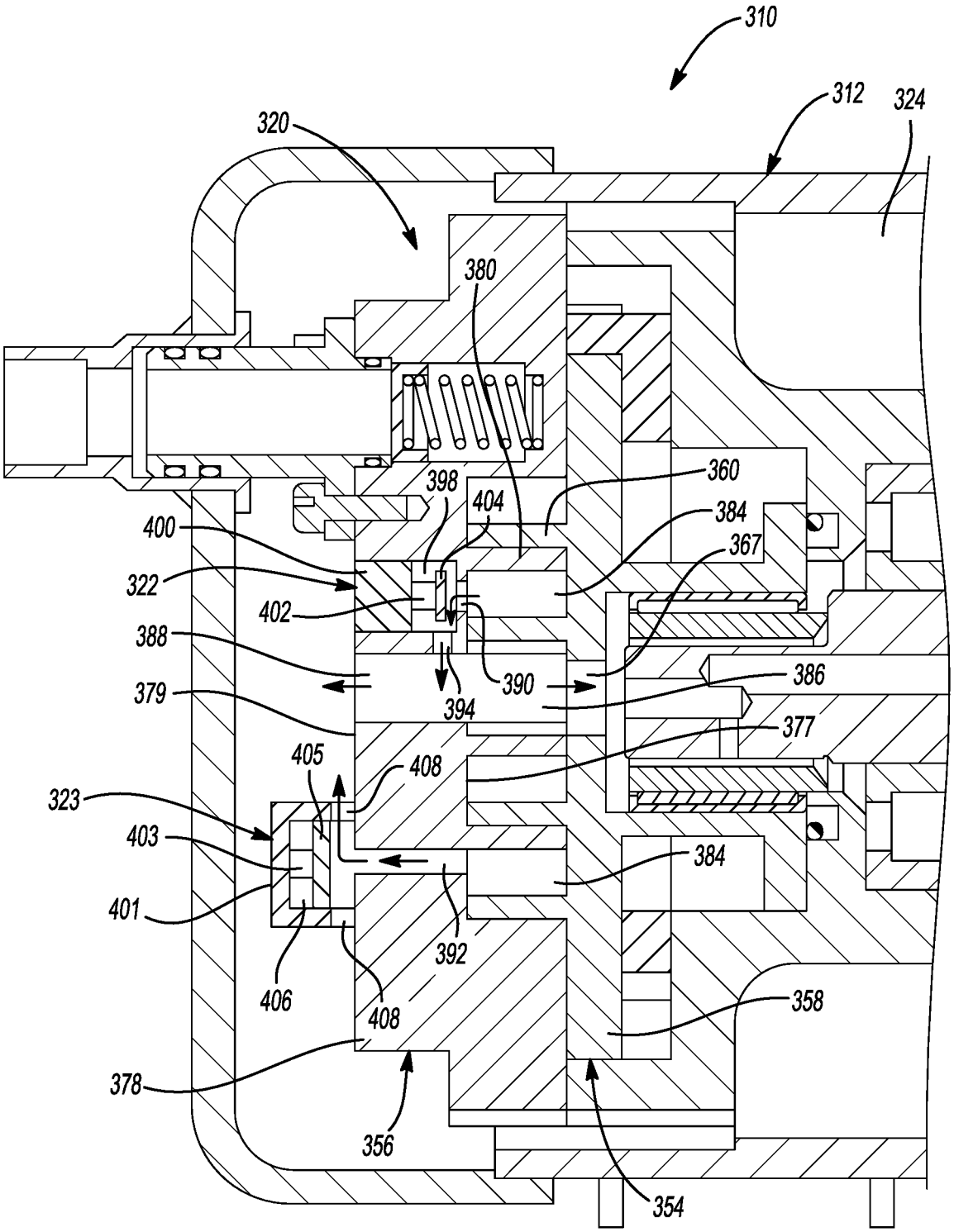
FIG. 4 is a partial cross-sectional view of another compressor according to the principles of the present disclosure.

Referring now to FIG. 4, another compressor 310 is provided. The structure and function of the compressor 310 may be similar or identical to that of the compressor 10, apart from differences described below, and therefore, descriptions of at least some similar or identical features are omitted.

The compressor 310 may be a high-side compressor including a compression mechanism 320 and first and second variable-volume-ratio (VVR) valve assemblies 322, 323. Like the compression mechanism 20 described above, the compression mechanism 320 may be disposed in a discharge chamber 324 (defined by a shell assembly 312; similar or identical to the discharge chamber 24) and may include an orbiting scroll 354 and a non-orbiting scroll 356.

The structure and function of the orbiting scroll 354 may be similar or identical to that of the orbiting scroll 54. That is, the orbiting scroll 54 may include an end plate 358 and a spiral wrap 360 extending from the end plate 358. The end plate 358 may include a discharge passage 367 in communication with the discharge chamber 324.

The non-orbiting scroll 356 may include an end plate 378 and a spiral wrap 380 projecting from the end plate 378. The end plate 378 of the non-orbiting scroll 356 may include a discharge passage 388, one or more first VVR ports 390, and one or more second VVR ports 392. The discharge passage 388 may be in communication with the discharge chamber 324, a fluid pocket at the radially innermost position 386, and the discharge passage 367 in the orbiting scroll 354. The first and second VVR ports 390, 392 are disposed radially outward relative to the discharge passages 367, 388 and communicate with respective fluid pockets at radially intermediate positions 384. The first VVR port 390 may be in selective communication with the discharge passage 388 via a radial passage 394. The second VVR port 392 may extend through first and second ends 377, 379 of the end plate 378. In the configuration shown in FIG. 4, the discharge passage 388 extends through the first and second ends 377, 379 of the end plate 378 and may communicate directly with the discharge chamber 324.

As described above, the VVR ports 390, 392 and the VVR valve assemblies 322, 323 are operable to prevent the compression mechanism 20 from over-compressing working fluid. The VVR valve assemblies 322, 323 are operable to selectively allow and restrict communication between the first and second VVR ports 390, 392 and the discharge chamber 324. The first VVR valve assembly 322 may be disposed in a valve recess 398 formed in the end plate 378 of the non-orbiting scroll 356. The structure and function of the first VVR valve assembly 322 may be similar or identical to that of the VVR valve assemblies 22 described above. Briefly, the first VVR valve assembly 322 may include a valve backer 400, a spring 402, and a VVR valve member 404. The valve backer 400 may be fixed to the end plate 378 and may close off or plug an end of the valve recesses 98. In some configurations, the valve backer 400 may be fixedly received (e.g., via threaded engagement, press fit, etc.) within the valve recess 398, as shown in FIG. 4.

The second VVR valve assembly 323 may be mounted to the second end 379 of the end plate 378 and may include a valve housing or backer 401, a spring 403, and a VVR valve member 405. The valve backer 401 of the second VVR valve assembly 323 may be fixedly mounted to the second end 379 of the end plate 378 and may define a cavity 406 in which the spring 403 and valve member 405 are movably disposed. The valve backer 401 may include one or more apertures 408 in communication with the discharge chamber 324 and the cavity 406.

In the configuration shown in FIG. 4, the valve members 404, 405 are generally disk-shaped bodies (e.g., with flat or curved end faces). In other configurations, the valve members 404, 405 could have or include other shapes, such as spherical, conical, frusto-conical, cylindrical, and/or annular for example. The springs 402, 403 may be coil springs, for example, or any other resiliently compressible bodies.

Like the valve members 104, the valve member 404 of the first VVR valve assembly 322 may be received within the valve recess 398 and is movable therein between a closed position restricting fluid flow between the first VVR port 390 and the radial passage 394 and an open position allowing fluid to flow from the VVR port 390 to the radial passage 394 into the discharge passage 388 and subsequently through either of the discharge passages 367, 388 to the discharge chamber 324.

The valve member 405 of the second VVR valve assembly 323 is movably disposed within the cavity 406 between a closed position and an open position. In the closed position, the valve member 405 contacts the second end 379 of the end plate 378 and restricts fluid communication between the second VVR port 392 and the cavity 406. In the open position, the valve member 405 is spaced apart from the end plate 378 to allow fluid to flow from the second VVR port 392 to the discharge chamber (via the cavity 406 and apertures 408).

While the compressor 310 is described above and shown in FIG. 4 with the VVR ports 390, 392 being structured differently from each other and the VVR valve assemblies 322, 323 being structured differently from each other, in some configurations, the VVR ports 390, 392 may have similar or identical structure and the VVR valve assemblies 322, 323 may have similar or identical structure.

Figure 5:
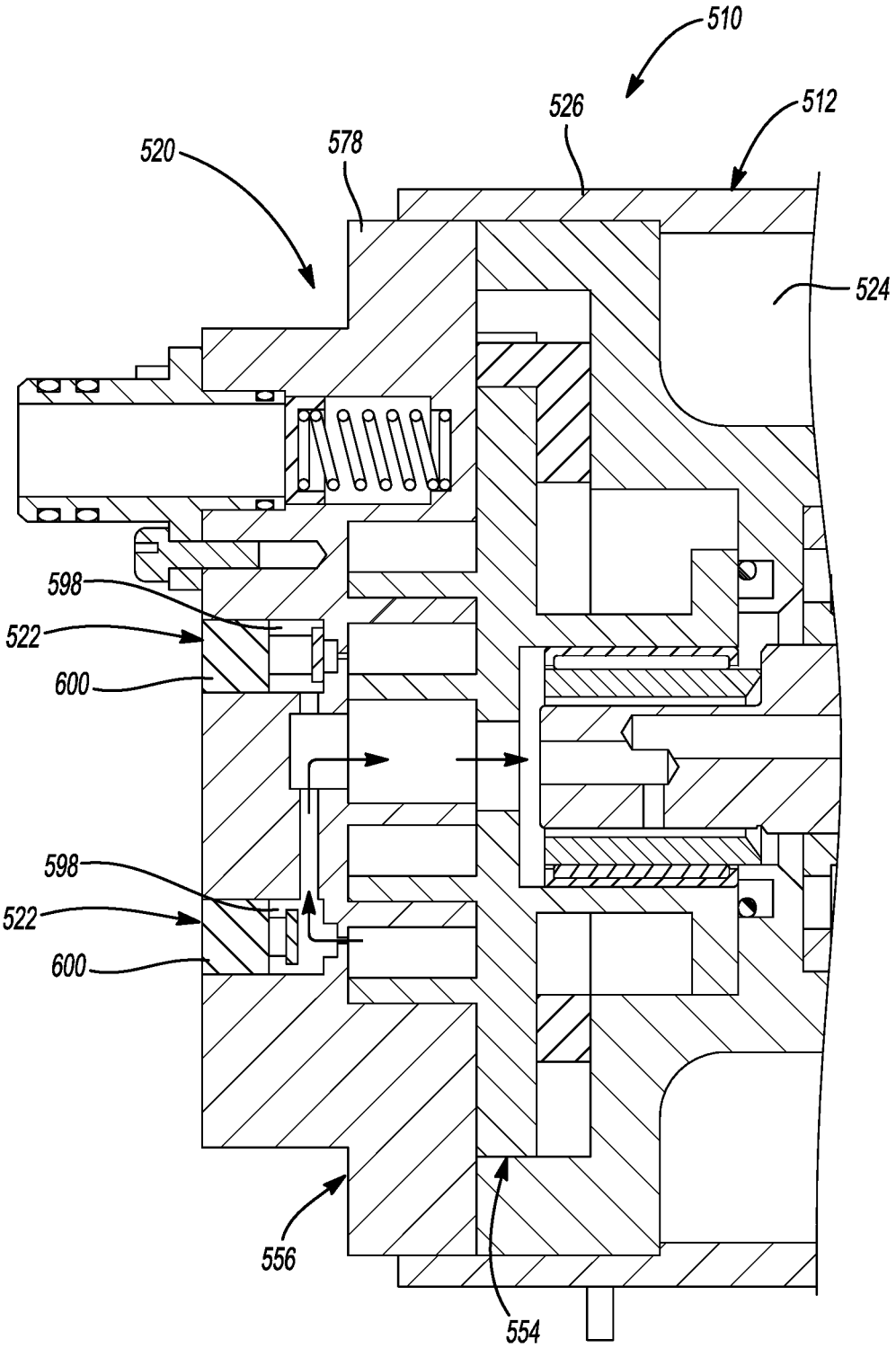
FIG. 5 is a partial cross-sectional view of yet another compressor according to the principles of the present disclosure.

Referring now to FIG. 5, another high-side compressor 510 is provided. The structure and function of the compressor 510 may be similar or identical to that of the compressor 10 or 310 described above, except for differences described below. One such difference is that a shell assembly 512 of the compressor 510 does not include an end cap like the end cap 28. Like the compressor 10, the shell assembly 512 of the compressor 510 may include a cylindrical shell 526 (like shell 26) and could include an end cap or base like the end cap 30.

Like the compressor 10, the compressor 510 also includes a compression mechanism 520 and VVR valve assemblies 522. The compression mechanism 520 may include an orbiting scroll 554 and a non-orbiting scroll 556. The structure and function of the orbiting scroll 554 may be similar or identical to that of the orbiting scroll 54. The structure and function of the non-orbiting scroll 556 may be similar or identical to that of the non-orbiting scroll 56, except, unlike the non-orbiting scroll 56, an entire periphery of the end plate 578 of the non-orbiting scroll 556 may extend radially outward to fixedly engage (e.g., via welding) and seal against the shell 526. In this manner, the end plate 578 of the non-orbiting scroll 556 sealingly encloses a discharge chamber 524 (like discharge chamber 24) of the compressor 510. The end plate 578 is exposed to the ambient environment outside of the compressor 510. Valve backers 600 of the VVR valve assemblies 522 will sealingly plug or sealingly close off valve recesses 598 in which the VVR valve assemblies 522 are received. Therefore, the shell assembly 512 does not need an end cap like the end cap 28. Therefore, the overall height of the compressor 510 can be reduced to allow the compressor 510 to fit within a smaller space.

While not specifically shown in the figures, any of the compressors 10, 310, 510 could include ports and/or valves for vapor injection (i.e., passageways in one or both scroll members and valves that allow for selective injection of compressed working fluid into an intermediate-pressure compression pocket of the compression mechanism) and/or mechanical modulation (i.e., passageways in one or both scroll members and valves that allow for selective leakage of intermediate-pressure compression pockets to a suction conduit or other suction-pressure region of the compressor).

Figure 6:
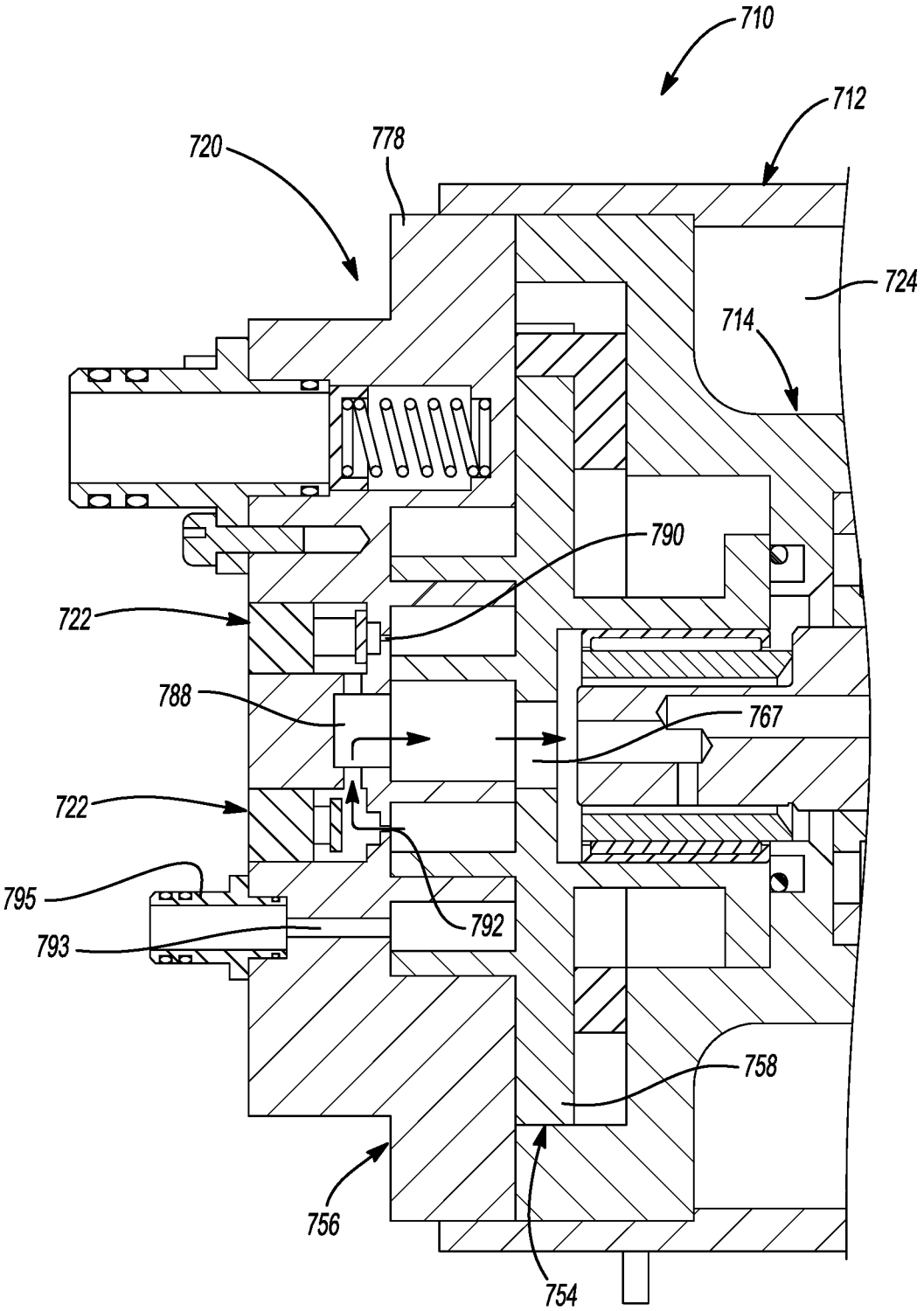
FIG. 6 is a partial cross-sectional view of yet another compressor according to the principles of the present disclosure.

Referring now to FIG. 6, another high-side compressor 710 is provided. The structure and function of the compressor 710 may be similar or identical to that of the compressor 510 described above, except for differences described below. Like the compressors 10, 510, the compressor 710 may include a shell assembly 712 (similar or identical to the shell assembly 512), a first bearing assembly 714 (similar or identical to the first bearing assembly 14), a second bearing assembly (not shown; similar or identical to the second bearing assembly 16), a motor assembly (not shown; similar or identical to the motor assembly 18), a compression mechanism 720 (similar to the compression mechanism 520), and one or more variable-volume-ratio (VVR) valve assemblies 722 (similar or identical to the VVR valve assemblies 22, 522).

Like the compression mechanism 520, the compression mechanism 720 may include an orbiting scroll 754 and a non-orbiting scroll 756. The structure and function of the orbiting scroll 754 may be similar or identical to that of the orbiting scroll 54, 554. Like the non-orbiting scroll 56, 556, an end plate 778 of the non-orbiting scroll 756 may include a discharge recess 788, one or more first VVR ports 790, and one or more second VVR ports 792. As described above, the VVR ports 792 may be in communication with the discharge recess 788 and respective fluid pockets at radially intermediate positions. The discharge recess 788 is in communication with a discharge passage 767 in an end plate of the 758 of the orbiting scroll 754.

The end plate 778 may also include one or more capacity-modulation ports 793 that may be in communication with one or more other fluid pockets at a radially intermediate position(s). One or more fittings 795 may engage the end plate 778 and may fluidly connect the capacity-modulation port(s) 793 with a fluid-injection source (e.g., a flash tank, an economizer, or another source of intermediate-pressure fluid that is at a pressure greater than suction-pressure fluid and less than discharge-pressure fluid). In this manner, intermediate-pressure fluid from the fluid-injection source can be injected into the fluid pocket via the capacity-modulation port 793 to modulate the capacity of the compressor 710. A valve assembly (e.g., a solenoid valve; not shown) may control a flow of fluid from the fluid-injection source to the fitting 795 and capacity-modulation port 793. In some configurations, a check valve (not shown) may be installed in the fitting 795 to restrict or prevent fluid from flowing from the capacity-modulation port 793 to the fitting 795.

Working fluid compressed by the compression mechanism 720 may be discharged from the compression mechanism 720 into a discharge chamber 724 through the discharge passage 767 in the end plate of the 758 of the orbiting scroll 754. Like the discharge chamber 24, 524, the discharge chamber 724 is a chamber defined by the shell assembly 712 in which the motor assembly, first and second bearing assemblies, and at least a portion of the orbiting scroll 754 are disposed.

Referring now to FIGS. 7*a* and 7*b*, another high-side compressor 910 is provided. The structure and function of the compressor 910 may be similar or identical to that of the compressor 510, 710 described above, except for differences described below. Like the compressor 710, the compressor 910 may include a shell assembly 912 (similar or identical to the shell assembly 712), a first bearing assembly 914 (similar or identical to the first bearing assembly 714), a second bearing assembly (not shown; similar or identical to the second bearing assembly 16), a motor assembly (not shown; similar or identical to the motor assembly 18), a compression mechanism 920 (similar to the compression mechanism 720), and one or more variable-volume-ratio (VVR) valve assemblies 922 (similar or identical to the VVR valve assemblies 22, 522, 722). The compressor 910 may also include one or more capacity-modulation valve assemblies 923.

Like the compression mechanism 520, the compression mechanism 920 may include an orbiting scroll 954 and a non-orbiting scroll 956. The structure and function of the orbiting scroll 954 may be similar or identical to that of the orbiting scroll 54, 554. Like the non-orbiting scroll 56, 556, an end plate 978 of the non-orbiting scroll 956 may include a discharge recess 988, one or more first VVR ports 990, and one or more second VVR ports 992. As described above, the VVR ports 992 may be in communication with the discharge recess 988 and respective fluid pockets at radially intermediate positions. The discharge recess 988 is in communication with a discharge passage 967 in an end plate of the 958 of the orbiting scroll 954.

The end plate 978 may also include one or more capacity-modulation ports 993 that may be in communication with one or more other fluid pockets at a radially intermediate position(s). A recess 995 may be formed in the end plate 978 and may provide communication between the capacity-modulation port 993 and a communication passage 997. The communication passage 997 may be formed in the end plate 978 and may be in communication with a suction-pressure region such as a suction inlet fitting 934, which may be similar or identical to inlet fitting 34.

The capacity-modulation valve assembly 923 may be a solenoid valve, for example, and may control fluid communication between the capacity-modulation port 993 and the communication passage 997. The capacity-modulation valve assembly 923 may include a valve housing 1010 and a capacity-modulation valve member 1012. The valve housing 1010 may be mounted to the end plate 978 and may define a cavity in which the capacity-modulation valve member 1012 is movable between a closed position (FIG. 7*a*) and an open position (FIG. 7*b*). In the closed position, the capacity-modulation valve member 1012 may abut a surface 1014 defining the recess 995 to restrict or prevent communication between the capacity-modulation port 993 and the communication passage 997 (thereby restricting or preventing fluid from flowing from the fluid pocket communicating with the capacity-modulation port 993 to the suction-pressure region). In the open position, the capacity-modulation valve member 1012 may be spaced apart from the surface 1014 to allow communication between the capacity-modulation port 993 and the communication passage 997 (thereby allowing fluid to flow from the fluid pocket communicating with the capacity-modulation port 993 to the suction-pressure region). In this manner, the capacity of the compressor 910 can be reduced by moving the capacity-modulation valve member 1012 into the open position.

While FIGS. 7*a* and 7*b* depict only a single capacity-modulation port 993 and a single capacity-modulation valve assembly 923, the compressor 910 could include multiple capacity-modulation ports 993 and multiple capacity-modulation valve assemblies 923. The multiple capacity-modulation valve assemblies 923 may be operable independently of each other to selectively operate the compressor 910 in one of several (i.e., more than two) capacity levels (e.g., 100% capacity, 75% capacity, 50% capacity, 25% capacity, etc.).

Working fluid compressed by the compression mechanism 920 may be discharged from the compression mechanism 920 into a discharge chamber 924 through the discharge passage 967 in the end plate of the 958 of the orbiting scroll 954. Like the discharge chamber 24, 524, the discharge chamber 924 is a chamber defined by the shell assembly 912 in which the motor assembly, first and second bearing assemblies, and at least a portion of the orbiting scroll 954 are disposed.

Referring now to FIGS. 8*a* and 8*b*, another high-side compressor 1110 is provided. The structure and function of the compressor 1110 may be similar or identical to that of the compressor 910 described above, except for differences described below. Like the compressor 910, the compressor 1110 may include a shell assembly 1112 (similar or identical to the shell assembly 912), a first bearing assembly 1114 (similar or identical to the first bearing assembly 914), a second bearing assembly (not shown; similar or identical to the second bearing assembly 16), a motor assembly (not shown; similar or identical to the motor assembly 18), a compression mechanism 1120 (similar to the compression mechanism 920), one or more variable-volume-ratio (VVR) valve assemblies 1122 (similar or identical to the VVR valve assemblies 22, 522, 722, 922), and one or more capacity-modulation valve assemblies 1123 (similar to the capacity-modulation valve assembly 923).

Like the compression mechanism 920, the compression mechanism 1120 may include an orbiting scroll 1154 and a non-orbiting scroll 1156. The structure and function of the orbiting scroll 1154 may be similar or identical to that of the orbiting scroll 54, 554. Like the non-orbiting scroll 56, 556, an end plate 1178 of the non-orbiting scroll 1156 may include a discharge recess 1188, one or more first VVR ports 1190, and one or more second VVR ports 1192. As described above, the VVR ports 1192 may be in communication with the discharge recess 1188 and respective fluid pockets at radially intermediate positions. The discharge recess 1188 is in communication with a discharge passage 1167 in an end plate of the 1158 of the orbiting scroll 1154.

The end plate 1178 may also include one or more capacity-modulation ports 1193 that may be in communication with one or more other fluid pockets at a radially intermediate position(s). A recess 1195 may be formed in the end plate 1178 and may provide communication between the capacity-modulation port 1193 and a communication passage 1197. The communication passage 1197 may be in communication with a suction-pressure region such as a suction inlet fitting 1134, which may be similar or identical to inlet fitting 34.

The capacity-modulation valve assembly 1123 may be a solenoid valve, for example, and may control fluid communication between the capacity-modulation port 1193 and the communication passage 1197. The capacity-modulation valve assembly 1123 may include a valve housing 1210 and a capacity-modulation valve member 1212. The valve housing 1210 may be mounted to the end plate 1178 and may define a cavity 1213 in which the capacity-modulation valve member 1212 is movable between a closed position (FIG. 8*a*) and an open position (FIG. 8*b*). In the closed position, the capacity-modulation valve member 1212 may abut a surface 1214 defining the recess 1195 to restrict or prevent communication between the capacity-modulation port 1193 and the communication passage 1197 (thereby restricting or preventing fluid from flowing from the fluid pocket communicating with the capacity-modulation port 1193 to the suction-pressure region). In the open position, the capacity-modulation valve member 1212 may be spaced apart from the surface 1214 to allow communication between the capacity-modulation port 1193 and the communication passage 1197 (thereby allowing fluid to flow from the fluid pocket communicating with the capacity-modulation port 1193 to the suction-pressure region). In this manner, the capacity of the compressor 1110 can be reduced by moving the capacity-modulation valve member 1212 into the open position.

While the communication passage 997 of the compressor 910 is described above as being formed in the end plate 978, the communication passage 1197 of the compressor 1110 may be a conduit (e.g., a tube or pipe) that is separate and spaced apart from the end plate 1178. The communication passage 1197 may be in communication with the suction inlet fitting 1134 and to the cavity 1213 of the valve housing 1210.

While FIGS. 8*a* and 8*b* depict only a single capacity-modulation port 1193 and a single capacity-modulation valve assembly 1123, the compressor 1110 could include multiple capacity-modulation ports 1193 and multiple capacity-modulation valve assemblies 1123. The multiple capacity-modulation valve assemblies 1123 may be operable independently of each other to selectively operate the compressor 1110 in one of several (i.e., more than two) capacity levels (e.g., 100% capacity, 75% capacity, 50% capacity, 25% capacity, etc.).

Working fluid compressed by the compression mechanism 1120 may be discharged from the compression mechanism 1120 into a discharge chamber 1124 through the discharge passage 1167 in the end plate of the 1158 of the orbiting scroll 1154. Like the discharge chamber 24, 524, the discharge chamber 1124 is a chamber defined by the shell assembly 1112 in which the motor assembly, first and second bearing assemblies, and at least a portion of the orbiting scroll 1154 are disposed.

Referring now to FIGS. 9*a*-9*c*, another high-side compressor 1310 is provided. The structure and function of the compressor 1310 may be similar or identical to that of the compressor 1110 described above, except for differences described below. Like the compressor 1110, the compressor 1310 may include a shell assembly 1312 (similar or identical to the shell assembly 1112), a first bearing assembly 1314 (similar or identical to the first bearing assembly 1114), a second bearing assembly (not shown; similar or identical to the second bearing assembly 16), a motor assembly (not shown; similar or identical to the motor assembly 18), a compression mechanism 1320 (similar to the compression mechanism 1120), one or more variable-volume-ratio (VVR) valve assemblies 1322 (similar or identical to the VVR valve assemblies 22, 522, 722, 922, 1122), and one or more capacity-modulation valve assemblies 1323.

Like the compression mechanism 1120, the compression mechanism 1320 may include an orbiting scroll 1354 and a non-orbiting scroll 1356. The structure and function of the orbiting scroll 1354 may be similar or identical to that of the orbiting scroll 54, 554. Like the non-orbiting scroll 56, 556, an end plate 1378 of the non-orbiting scroll 1356 may include a discharge recess 1388, one or more first VVR ports 1390, and one or more second VVR ports 1392. As described above, the VVR ports 1392 may be in communication with the discharge recess 1388 and respective fluid pockets at radially intermediate positions. The discharge recess 1388 is in communication with a discharge passage 1367 in an end plate of the 1358 of the orbiting scroll 1354.

The end plate 1378 may also include one or more capacity-modulation ports 1393 that may be in communication with one or more other fluid pockets at a radially intermediate position(s). A recess 1395 may be formed in the end plate 1378 and may provide communication between the capacity-modulation port 1393 and a first communication passage 1397 (similar or identical to the communication passage 1197) and a second communication passage (e.g., a fluid-injection passage) 1399. The first communication passage 1397 may be in communication with a suction-pressure region such as a suction inlet fitting 1334, which may be similar or identical to inlet fitting 34. The second communication passage 1399 may be in communication with a fluid-injection source (e.g., a flash tank, an economizer, or another source of intermediate-pressure fluid that is at a pressure greater than suction-pressure fluid and less than discharge-pressure fluid).

The capacity-modulation valve assembly 1323 may be a solenoid valve, for example, and may control fluid communication between the capacity-modulation port 1393 and the first and second communication passages 1397, 1399. The capacity-modulation valve assembly 1323 may include a valve housing 1410 and a capacity-modulation valve member 1412. The valve housing 1410 may be mounted to the end plate 1378 and may define a cavity 1413 in which the capacity-modulation valve member 1412 is movable between a first position (FIG. 9*a*), a second position (FIG. 9*b*), and a third position (FIG. 9*c*). The capacity-modulation valve member 1412 may be an elongated, generally cylindrical rod having a first radially extending protrusion 1416, a second radially extending protrusion 1418, and a third radially extending protrusion 1420.

In the first position (FIG. 9*a*), an axial end 1422 of the capacity-modulation valve member 1412 may abut a surface 1414 defining the recess 1395 to restrict or prevent communication between the capacity-modulation port 1393 and the communication passages 1397, 1399 (thereby restricting or preventing fluid from flowing from the fluid pocket communicating with the capacity-modulation port 1393 to the suction-pressure region and restricting or preventing fluid from flowing from the fluid-injection source to the fluid pocket communicating with the capacity-modulation port 1393). In the first position, the first radially extending protrusion 1416 of the capacity-modulation valve member 1412 may block the first communication passage 1397 to restrict or prevent communication between the cavity 1413 and the first communication passage 1397. Furthermore, in the first position, the second radially extending protrusion 1418 of the capacity-modulation valve member 1412 may block the second communication passage 1399 to restrict or prevent communication between the cavity 1413 and the second communication passage 1399.

In the second position (FIG. 9*b*), axial end 1422 of the capacity-modulation valve member 1412 may be spaced apart from the surface 1414 to allow communication between the capacity-modulation port 1393 and the cavity 1413. Furthermore, in the second position, the first radially extending protrusion 1416 of the capacity-modulation valve member 1412 may still block the first communication passage 1397 to restrict or prevent communication between the cavity 1413 and the first communication passage 1397 (thereby restricting or preventing fluid from flowing from the fluid pocket communicating with the capacity-modulation port 1393 to the suction-pressure region). Furthermore, in the second position, the second and third radially extending protrusions 1418, 1420 of the capacity-modulation valve member 1412 may be axially spaced apart from the second communication passage 1399 to allow communication between the second communication passage 1399 and the cavity 1413 (thereby allowing intermediate-pressure fluid from the fluid-injection source to be injected into the fluid pocket communicating with the capacity-modulation port 1393). In this manner, the capacity of the compressor 1310 can be increased by moving the capacity-modulation valve member 1412 into the second position.

In the third position (FIG. 9*c*), axial end 1422 of the capacity-modulation valve member 1412 is spaced farther apart from the surface 1414 and allows communication between the capacity-modulation port 1393 and the cavity 1413. Furthermore, in the third position, the first radially extending protrusion 1416 of the capacity-modulation valve member 1412 may be axially spaced apart from the first communication passage 1397 to allow communication between the cavity 1413 and the first communication passage 1397 (thereby allowing fluid to flow from the fluid pocket communicating with the capacity-modulation port 1393 to the suction-pressure region). Furthermore, in the third position, the third radially extending protrusion 1420 of the capacity-modulation valve member 1412 may block the second communication passage 1399 to restrict or prevent communication between the second communication passage 1399 and the cavity 1413 (thereby restricting or preventing communication between the fluid-injection source and the fluid pocket communicating with the capacity-modulation port 1393). In this manner, the capacity of the compressor 1310 can be reduced by moving the capacity-modulation valve member 1412 into the third position.

Working fluid compressed by the compression mechanism 1320 may be discharged from the compression mechanism 1320 into a discharge chamber 1324 through the discharge passage 1367 in the end plate of the 1358 of the orbiting scroll 1354. Like the discharge chamber 24, 524, the discharge chamber 1324 is a chamber defined by the shell assembly 1312 in which the motor assembly, first and second bearing assemblies, and at least a portion of the orbiting scroll 1354 are disposed.

The motor assemblies of any of the compressors 10, 310, 510, 710, 910, 1110, 1310 can be fixed-speed, multi-speed, or variable-speed motors, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a discharge chamber;

a non-orbiting scroll including a first end plate and a first spiral wrap extending from the first end plate, the first end plate including a variable-volume-ratio port; and an orbiting scroll disposed within the discharge chamber and including a second end plate and a second spiral wrap extending from the second end plate and cooperating with the first spiral wrap to define a plurality of fluid pockets therebetween, the second end plate including a discharge passage, the discharge passage in communication with a radially innermost one of the fluid pockets and the discharge chamber, wherein the variable-volume-ratio port is disposed radially outward relative to the discharge passage and is in selective communication with the radially innermost one of the fluid pockets, and wherein fluid flows from a radially intermediate one of the fluid pockets into the variable-volume-ratio port in the non-orbiting scroll, then the fluid flows from the variable-volume-ratio port into the radially innermost one of the fluid pockets, and then the fluid flows from the radially innermost one of the fluid pockets through the discharge passage into the discharge chamber.

2. The compressor of claim 1, wherein the radially innermost one of the fluid pockets is in communication with the discharge chamber only through the discharge passage.

3. The compressor of claim 2, wherein the orbiting scroll includes an annular hub extending from the second end plate in a direction opposite the second spiral wrap, wherein the annular hub defines a cavity that receives a driveshaft, and wherein the discharge passage is open to and directly adjacent to the cavity.

4. The compressor of claim 1, wherein the non-orbiting scroll is enclosed within the shell assembly and is disposed within the discharge chamber.

5. The compressor of claim 1, wherein the non-orbiting scroll sealingly engages the shell assembly to seal the discharge chamber.

6. The compressor of claim 5, wherein the non-orbiting scroll is exposed to an ambient environment outside of the compressor.

7. The compressor of claim 5, further comprising a discharge fitting extending through the shell assembly and in communication with the discharge chamber, and wherein the discharge fitting is spaced apart from the non-orbiting scroll.

8. The compressor of claim 1, further comprising a variable-volume-ratio valve member movable relative to the non-orbiting scroll between an open position in which the variable-volume-ratio valve member allows fluid flow between the variable-volume-ratio port and the discharge chamber and a closed position in which the variable-volume-ratio valve member restricts fluid flow between the variable-volume-ratio port and the discharge chamber.

9. The compressor of claim 8, wherein the first end plate of the non-orbiting scroll includes a valve recess in which the variable-volume-ratio valve member is movable between the open and closed positions, and wherein the valve recess is in communication with the discharge chamber and the variable-volume-ratio port when the variable-volume-ratio valve member is in the open position.

10. The compressor of claim 9, further comprising:

a valve backer closing an end of the valve recess; and a spring disposed between the valve backer and the variable-volume-ratio valve member and biasing the variable-volume-ratio valve member toward the closed position.

11. The compressor of claim 1, wherein the first end plate includes a capacity-modulation port in communication with a radially intermediate one of the fluid pockets.

12. The compressor of claim 11, further comprising a capacity-modulation valve assembly movable between a first position restricting communication between the capacity-modulation port and a suction-pressure region and a second position allowing communication between the capacity-modulation port and the suction-pressure region.

13. The compressor of claim 12, wherein the capacity-modulation valve assembly is movable to a third position restricting communication between the capacity-modulation port and the suction-pressure region and allowing communication between fluid-injection passage and the capacity-modulation port.

14. A compressor comprising:

a shell assembly defining a discharge chamber;

a non-orbiting scroll including a first end plate and a first spiral wrap extending from the first end plate, the first end plate including a variable-volume-ratio port and a first discharge passage, the variable-volume-ratio port disposed radially outward relative to the first discharge passage and in selective communication with the discharge chamber, the first discharge passage in communication with the discharge chamber; and an orbiting scroll disposed within the discharge chamber and including a second end plate and a second spiral wrap extending from the second end plate and cooperating with the first spiral wrap to define a plurality of fluid pockets therebetween, the second end plate including a second discharge passage in communication with the discharge chamber, wherein the first discharge passage and the second discharge passage are in communication with a radially innermost one of the fluid pockets and the discharge chamber, wherein the variable-volume-ratio port is disposed radially outward relative to the first and second discharge passages and is in selective communication with the radially innermost one of the fluid pockets, and wherein fluid flows from a radially intermediate one of the fluid pockets into the variable-volume-ratio port in the non-orbiting scroll, then the fluid flows from the variable-volume-ratio port into the radially innermost one of the fluid pockets, and then the fluid flows from the radially innermost one of the fluid pockets through the second discharge passage into the discharge chamber.

15. The compressor of claim 14, wherein the second discharge passage is in selective fluid communication with the variable-volume-ratio port.

16. The compressor of claim 15, wherein the first discharge passage extends entirely through the first end plate, and wherein the second discharge passage extends entirely through the second end plate.

17. The compressor of claim 16, wherein the orbiting scroll includes an annular hub extending from the second end plate in a direction opposite the second spiral wrap, wherein the annular hub defines a cavity that receives a driveshaft, and wherein the second discharge passage is open to and directly adjacent to the cavity.

18. The compressor of claim 14, further comprising a variable-volume-ratio valve member movable relative to the non-orbiting scroll between an open position in which the variable-volume-ratio valve member allows fluid flow between the variable-volume-ratio port and the discharge chamber and a closed position in which the variable-volume-ratio valve member restricts fluid flow between the variable-volume-ratio port and the discharge chamber.

19. The compressor of claim 18, wherein the variable-volume-ratio port communicates with the discharge chamber via one or both of the first and second discharge passages when the variable-volume-ratio valve member is in the open position.

20. The compressor of claim 19, wherein the first end plate of the non-orbiting scroll includes a valve recess in which the variable-volume-ratio valve member is movable between the open and closed positions, and wherein the valve recess is in communication with the first and second discharge passages and the variable-volume-ratio port when the variable-volume-ratio valve member is in the open position.

21. The compressor of claim 20, further comprising:

a valve backer closing an end of the valve recess; and a spring disposed between the valve backer and the variable-volume-ratio valve member and biasing the variable-volume-ratio valve member toward the closed position.

22. The compressor of claim 14, wherein the first end plate includes a capacity-modulation port in communication with a radially intermediate one of the fluid pockets.

23. The compressor of claim 22, further comprising a capacity-modulation valve assembly movable between a first position restricting communication between the capacity-modulation port and a suction-pressure region and a second position allowing communication between the capacity-modulation port and the suction-pressure region.

24. The compressor of claim 23, wherein the capacity-modulation valve assembly is movable to a third position restricting communication between the capacity-modulation port and the suction-pressure region and allowing communication between fluid-injection passage and the capacity-modulation port.

* * * * *